US009241528B2

(12) United States Patent
Partlo

(10) Patent No.: US 9,241,528 B2
(45) Date of Patent: Jan. 26, 2016

(54) SPORT SAFETY HEADGEAR WITH BRACING SYSTEM AND WARNING SYSTEM

(71) Applicant: Loren George Partlo, Coleman, MI (US)

(72) Inventor: Loren George Partlo, Coleman, MI (US)

( * ) Notice: Subject to any disclaimer, the term of this patent is extended or adjusted under 35 U.S.C. 154(b) by 37 days.

(21) Appl. No.: 14/194,901

(22) Filed: Mar. 3, 2014

(65) Prior Publication Data

US 2015/0245680 A1 Sep. 3, 2015

(51) Int. Cl.
*A42B 3/04* (2006.01)
*A42B 3/00* (2006.01)

(52) U.S. Cl.
CPC ..... *A42B 3/046* (2013.01); *A42B 3/0473* (2013.01)

(58) Field of Classification Search
CPC ..... A61B 5/6803; A61B 2562/0219; A61B 5/4064; A61B 5/11; A61B 5/7282; A61B 2562/0247; A61B 5/002; A61B 5/0022; A61B 5/103; A61B 5/0482; A61B 5/1036; A61B 5/1116; A61B 5/6814; A61B 5/746; A61B 2503/10; A61B 5/0042; F41H 1/04; F41H 1/00; A41D 13/015; A41D 13/0512; A63B 2220/40; A63B 71/0054; A63B 71/10; A63B 2071/0063; A63B 2220/836; A63B 2220/00; A63B 2220/53; A63B 2225/20; A63B 2225/50; A63B 2225/54; A63B 2243/0025; A63B 2243/0066; A63B 71/085; A63B 71/12; A63B 71/1291
See application file for complete search history.

(56) References Cited

U.S. PATENT DOCUMENTS

| | | | | |
|---|---|---|---|---|
| 5,056,155 | A * | 10/1991 | Truxell | 2/2.5 |
| 5,447,168 | A * | 9/1995 | Bancroft | 128/859 |
| 5,718,004 | A * | 2/1998 | Broersma et al. | 2/425 |
| 5,745,923 | A * | 5/1998 | Katz | 2/411 |
| 6,588,022 | B1 * | 7/2003 | Anders et al. | 2/421 |
| 7,100,217 | B2 * | 9/2006 | Panzenbock et al. | 2/463 |
| 7,328,462 | B1 * | 2/2008 | Straus | 2/411 |
| 8,196,226 | B1 * | 6/2012 | Schuh | 2/412 |
| 8,262,601 | B2 * | 9/2012 | Cumming et al. | 602/74 |
| 8,429,766 | B2 * | 4/2013 | Halfaker | 2/209 |
| 8,554,495 | B2 * | 10/2013 | Mack et al. | 702/41 |
| 8,568,311 | B2 * | 10/2013 | LaPlaca et al. | 600/301 |
| 8,621,673 | B1 * | 1/2014 | Pietrantonio | 2/425 |
| 8,708,868 | B2 * | 4/2014 | Partlo | 482/88 |
| 8,844,066 | B1 * | 9/2014 | Whitcomb | 2/413 |
| 8,898,818 | B1 * | 12/2014 | Whitcomb | 2/413 |
| 8,918,918 | B2 * | 12/2014 | Jackson | 2/425 |
| 8,925,118 | B2 * | 1/2015 | Pietrantonio | 2/425 |
| 8,961,440 | B2 * | 2/2015 | Huang | 600/595 |
| 8,984,664 | B2 * | 3/2015 | Moss et al. | 2/6.1 |
| 8,986,798 | B2 * | 3/2015 | Anderson et al. | 428/34.1 |
| 9,026,396 | B2 * | 5/2015 | Evans et al. | 702/141 |

(Continued)

*Primary Examiner* — Bobby Muromoto, Jr.

(57) ABSTRACT

A protective headgear having an axial rotation control and bracing system, a head and neck linking system and impact safety warning system made for a single player. The axial rotation control and bracing system is designed to reduce linear and axial rotation of the head and allow for bracing; a headgear with multiple embodiments. Constructed of energy absorbent material to dissipate and transfer excessive impact energy to the torso of the player. A headgear which links the head and neck to improve effective mass thereby reducing head acceleration to minimize transfer of force and mechanical effect on the brain. A headgear having a non-removable electronic communication system designed for: measuring, collecting, monitoring, storing, interpreting and transmitting linear and rotational acceleration impact data. An impact safety warning system with pre-determined force threshold that when met or exceeded will identify and stop play so medical assessment can be conducted.

16 Claims, 11 Drawing Sheets

(56) References Cited

U.S. PATENT DOCUMENTS

| | | | | |
|---|---|---|---|---|
| 2010/0005571 | A1* | 1/2010 | Moss et al. | 2/410 |
| 2010/0171353 | A1* | 7/2010 | Ferro Montiu | 297/397 |
| 2010/0331752 | A1* | 12/2010 | Cumming et al. | 602/74 |
| 2011/0030113 | A1* | 2/2011 | Imholt et al. | 2/6.7 |
| 2011/0144539 | A1* | 6/2011 | Ouchi | 600/587 |
| 2011/0184663 | A1* | 7/2011 | Mack et al. | 702/41 |
| 2011/0205022 | A1* | 8/2011 | Cavallaro et al. | 340/8.1 |
| 2011/0207990 | A1* | 8/2011 | Mersky | 600/25 |
| 2011/0215931 | A1* | 9/2011 | Callsen et al. | 340/573.1 |
| 2011/0218756 | A1* | 9/2011 | Callsen et al. | 702/139 |
| 2011/0218757 | A1* | 9/2011 | Callsen et al. | 702/141 |
| 2011/0275935 | A1* | 11/2011 | Ginsburg et al. | 600/433 |
| 2012/0036698 | A1* | 2/2012 | Guertin | 29/428 |
| 2012/0083688 | A1* | 4/2012 | Nauman et al. | 600/419 |
| 2012/0092178 | A1* | 4/2012 | Callsen et al. | 340/669 |
| 2012/0124720 | A1* | 5/2012 | Evans et al. | 2/424 |
| 2012/0246788 | A1* | 10/2012 | Harrell et al. | 2/2.5 |
| 2012/0283193 | A1* | 11/2012 | Spitzer et al. | 514/18.1 |
| 2012/0296252 | A1* | 11/2012 | Cumming et al. | 602/45 |
| 2013/0074248 | A1* | 3/2013 | Evans et al. | 2/421 |
| 2013/0150684 | A1* | 6/2013 | Cooner | 600/301 |
| 2013/0158670 | A1* | 6/2013 | Tigno, Jr. | 623/17.19 |
| 2013/0167290 | A1* | 7/2013 | Ben Ezra | 2/425 |
| 2013/0189795 | A1* | 7/2013 | Mentzer | 436/501 |
| 2013/0223709 | A1* | 8/2013 | Wagner | 382/128 |
| 2013/0271602 | A1* | 10/2013 | Bentley et al. | 348/143 |
| 2013/0296141 | A1* | 11/2013 | Partlo | 482/84 |
| 2014/0052405 | A1* | 2/2014 | Wackym | 702/141 |
| 2014/0053324 | A1* | 2/2014 | Jackson | 2/425 |
| 2014/0081601 | A1* | 3/2014 | Zhang et al. | 703/1 |
| 2014/0170211 | A1* | 6/2014 | Bennett et al. | 424/451 |
| 2014/0257017 | A1* | 9/2014 | Arendash et al. | 600/14 |
| 2014/0266752 | A1* | 9/2014 | John | 340/665 |
| 2014/0288462 | A1* | 9/2014 | Pietrantonio | 600/587 |
| 2014/0323921 | A1* | 10/2014 | Huang | 600/587 |
| 2014/0376876 | A1* | 12/2014 | Bentley et al. | 386/227 |
| 2015/0040685 | A1* | 2/2015 | Nicholson et al. | 73/862.51 |
| 2015/0080768 | A1* | 3/2015 | Huang | 600/595 |

* cited by examiner

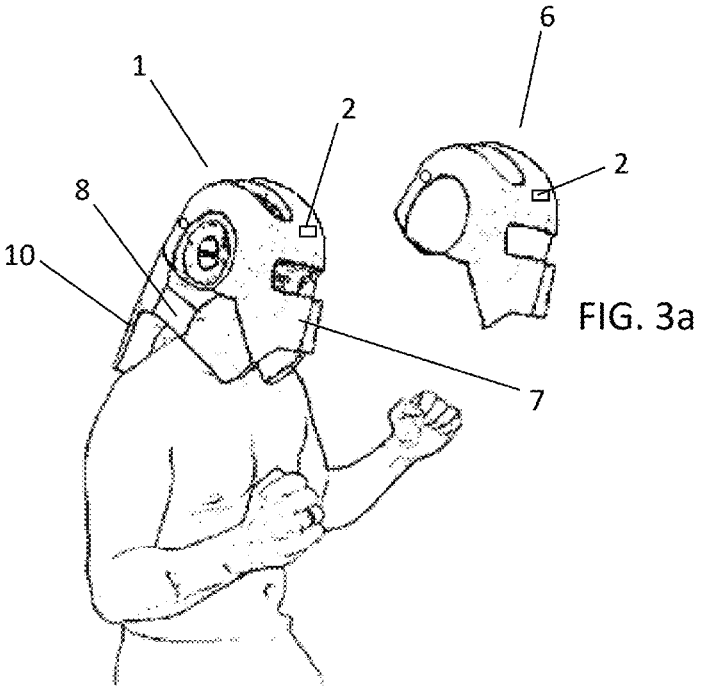
FIG. 3a
FIG. 3
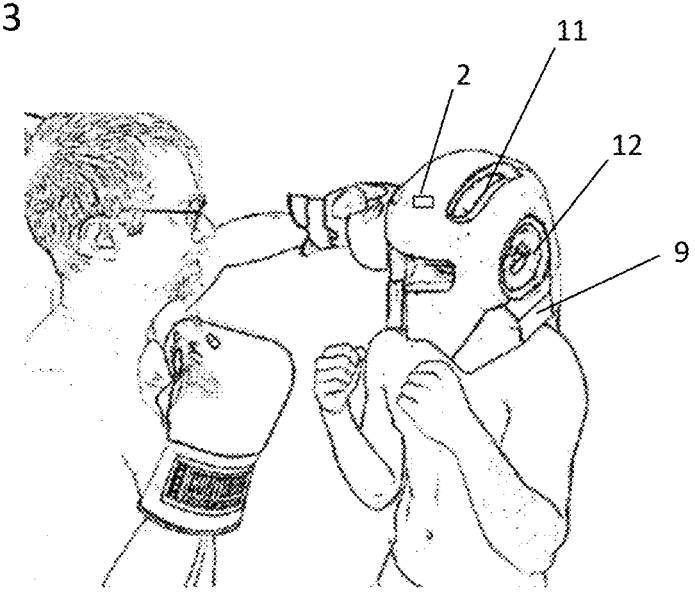
FIG.4

SPORT SAFETY HEADGEAR WITH BRACING SYSTEM AND WARNING SYSTEM

CROSS-REFERENCE TO RELATED APPLICATIONS

U.S. Patent Documents

| | | |
|---|---|---|
| 8,201,277 | June 2012 | Olivarez |
| 8,554,509 | October 2013 | Crisco, III, et al. |
| 8,590,064 | November 2013 | Castillo |
| 20130340150 | December 2013 | Brantley |
| 20130333100 | December 2013 | Erb |
| 8,561,217 | October 2013 | Negley |
| 20120210498 | January 2011 | Mack |
| 20100263110 | October 2010 | Berry |
| 8,621,673 | January 2014 | Pietrantonio |
| 8,196,226 | June 2012 | Schuh |
| 8,621,672 | January 2014 | Chuback |
| 7,739,752 | June 2010 | Tsujimoto |

Other References http://shop.reebok.com/us/product/boys-girls-men-women-checklight-apparel/BH303?cm_mmc=RbkSEM_google_ecom-_-Checklight-_-Checklight-_-Reebok&cm_mmcal=US&cm_mmca2=b Reebok Checklight.

http://www.x2biosystems.com/x2_x_patch/X2 Biosystems

STATEMENT REGARDING FEDERALLY SPONSORED RESEARCH OR DEVELOPMENT

Not applicable

FIELD OF THE INVENTION

The invention is a head covering used to protect the head while performing sports activities where injury to the head is apt to occur. This headgear is specifically for body-contact sports such as boxing, football, hockey and similar contact sports. The sport headgear (the current invention) is designed with an axial rotation control and bracing system that is designed to limit range of motion and transfer head impact force to the torso and allow the wearer to brace themselves for impact to reduce translational and rotational head impacts. Additionally, the sport headgear has a head and neck linking system designed to link the head and neck into a single unit and support the neck and flex with the neck and head during a head impact. Additionally, the current invention has an impact safety warning system designed to immediately notify via a flashing light/strobe and auditory alarm everyone in the area when a preset force threshold is met or acceded so a contest can be stopped immediately and the player assessed for possible injury. The impact safety warning system is an electronic data processing feature imbedded within the headgear that uses one or more accelerometer(s) to: electronically measure, monitor, interpret and transmit directional and rotational impact force data of head impacts to allow research to be conducted on actual impact forces encountered during practice and competition.

BACKGROUND OF THE INVENTION

Protecting a person's head while in war or playing sports has been a developing science since war, sports and headgear first stated to be created. Please note that one of the goals of the current invention is to limit rotational movement and provide a bracing ability and direct force as well as absorb force. Another goal is to link the head and neck as a single unit. Another goal is to provide an intervention system to identify a significant impact force and announce it so play can be stopped. It is not an invention claiming to prevent closed head injuries but one to assist in limiting the range of motion and to provide support the neck and head which may assist in reducing the acceleration of a movement and hopefully the result will be a reduction in closed head injuries. The goal to increase the safety of the player has not changed. However, current understanding of the factors that cause injury and the types of injuries have improved as mankind strives to understand how injuries occur and how equipment may decrease or negate these injuries. The answer historically as documented in the U.S. Patent data base has been to improve the type of shock absorbent padding or the type of exterior of the helmet that protects the head. This is of great importance because the idea has been to build a better covering for the head and the head alone. With current understanding of traumatic brain injuries and the motion of the brain during a head impact more questions on methods to understand and limit linear and or translational and rotational forces as they impact the brain have arisen. New patents like this one, seek to provide a method to reduce the factors that cause impact trauma but also provide a feature to monitor head impacts. Please note the current invention intent is to monitor impacts on the headgear not in the brain of the player. Also the terms headgear and helmet are used interchangeably.

There are five aspects in the design that the axial rotation control and bracing system and head and neck linking system hope to improve and thereby reduce head injuries: limiting the axis of movement, providing a bracing feature, linking the head and neck as a single unit, transferring energy to the torso of the player, and supporting the head and neck during impact.

One problem encountered in head injuries is the role axial and rotational movement play during head acceleration. In the current invention this problem is addressed by creating the axial rotation control and bracing system. The system is designed to reduce the axis of movement of the head and neck in an attempt to limit translational and rotational forces delivered to the brain during a head impact. By reducing the range of motion the force is given a shorter amount of time to build speed of movement regarding the head because the range of movement has been decreased. This should assist in reducing translational force build up and the eventual transference of this force to the player's brain.

Another problem encountered in head injuries is due to the whiplash movement that takes place when the head is hit. The current invention within the axial rotation control and bracing system provides a method for the wearer to brace themselves for impact. The design of the axial rotation control system also provides shock absorbance during the impact as well as providing a method for bracing for impact. No other headgear has a feature where the wearer can take a preventative measure to help reduce the effect of a blow if they see it coming.

Another problem encountered in head injuries is that traditional headgear(s) only cover the head. Because of this the neck moves freely providing more opportunity for injury and the head alone takes all the force impact or the brain receives more trauma because the neck provides a medium for a whiplash movement to take place. The current headgear seeks to not only absorb via padding some of the blunt force trauma it also seeks to provide a method to transfer energy from a head blow to the player's torso, also a feature gained by the axial rotation control and bracing system. No other headgear currently has this feature.

Another problem with head impacts is the weakness of the neck. The current headgear is specifically designed with a head and neck linking system. By extending the helmet to encompass the neck (traditional headgear only covers the skull) the headgear links the head and neck, to some extent, as one unit thereby reducing their ability to move independently. This linking, at least to some extent, mathematically, due to an increase of mass by now adding the neck mass and some rigidity of the head and neck linking system will assist in reducing head impact because it will then take a larger acceleration force to cause damage. No other headgear currently has this feature.

The sport headgear is specifically designed to address supporting the head and neck during an impact. The force absorbent material the axial rotation control and bracing system and head and neck linking system are made of support the head and neck and will move and flex to support the head and neck during an impact. This support is critical in absorbing force and transferring it from the headgear into the torso of the player. No other headgear currently has this support and flex feature.

The sport headgear also has an impact safety warning system. With the study of head impacts in sports you will find the terms Traumatic Brain Injury (TBI) Mild Traumatic Brain Injury (MTBI) which are injuries sustained by the brain because of the blunt trauma force or impact the brain receives because of a head impact. In short the brain hits the inside of the skull and damages itself due to acceleration movement force. Secondary Impact Syndrome (SIS) is when there is already a brain injury and the player continues to play and then gets hit with another impact that further exacerbates the initial injury causing an even larger injury.

The current invention seeks to reduce TBI and MTBI by the innovations within the design of the helmet and via the impact safety warning system as previously described. The concept of the impact safety warning system is one of intervention to hopefully reduce the occurrences of SIS. One of the major problems with head injuries specifically SIS is that the coach or parent may suspect but not really have a way to tell how hard the player was hit. Sometimes a player can be hit and actually receive a MTBI but no one knows or the player conceals it or thinks they aren't being tough if they admit they are hurt. It is hoped that the impact safety warning system can be used to provide an intervention to reduce MTBI by measuring headgear impact.

Regarding the impact safety warning system it is designed to measure headgear accelerations not brain accelerations. It is an intervention notification system designed to stop play. It is designed to provide immediate feedback to the players and people in the area during training and competition. The headgear also has a data storage capability. Although, it is not the intent of the impact safety warning system to be a Traumatic Brain Injury (TBI) research tool the data it collects may be beneficial to the study of head impacts and the further development of safety equipment. There are a number of data collection systems designed for measuring "body part" accelerations, this is not the aim of the current invention. The current invention is not removable from the headgear. Additionally, other systems that are TBI research based are not designed to provide access to parents or other possible interested parties that would like to be a receiving station. This is an important distinction to be made as the current invention is seeking to provide intervention against possible SIS and by providing a monitoring system that provides information to parents, coaches and other interested individuals who have a right to know the hope is it will assist in keeping players from playing if there is a suspected possibility of an event that caused harm.

The current invention electronics are designed for: collecting, monitoring, storing, interpreting and transmitting linear and rotational acceleration and force impact data in real time to a remote receiving computing device that are linked to the headgear(s) wirelessly so a judge, coach or parent can then monitor head impact data on the player anytime the headgear is in use and turned on. Providing the receiver has the appropriate software and code access.

It is not intended that the current invention measure brain impacts. The goal is to measure the acceleration of the headgear itself. This can provide information that can be helpful to the safety of the wearer. The current invention has an impact safety warning system which is unique, because it is integrally manufactured within the headgear which overcomes a problem of not using available technology. If the headgear has an impact safety warning system and the player is wearing it that is a large step in providing intervention, therefore the impact safety warning system is manufactured into the headgear and is not removable. The impact safety warning system has two simple functions.

The first is notification that a preset safety head impact threshold has been met or exceeded. This is not an indicator that a closed head injury has taken place but an indicator that a significant impact to the headgear has taken place that may have diverse effect on the brain of the player. The headgear can be programmed for a specific individual and is intended to stay with that one individual. Once the pre-set threshold is met or exceeded a bright flashing light indicator and auditory alarm will be triggered notifying everyone of the significant impact event, so play will be stopped immediately and the player assessed for a possible head injury. This function of the impact safety warning system is important in providing a usable commercial headgear that helps identify potential for head injuries and reduces the chances of coaches putting players back in play thereby exposing them to secondary brain injuries.

The second important function of the impact safety warning system is to provide an immediate ability to stop play so proper medical evaluation can take place when normally no intervention would happen. The current invention allows also for a method to track, on an individual basis, the total amount of head accelerations received and the intensity for an individual player during a single event or through the duration of the season or as long as the player uses the same headgear or until it is reset.

No other headgear has a safety warning system of a flashing light and auditory alarm specifically designed to stop play; imbedded within said headgear. Other, systems that collect data simply collect data or have an option to send data to a judging table where if the data is being watched by a judge who may or may not intervene. The current invention eliminates this monitoring requirement with the instantaneous light and audio warning system, it announces its self Other systems mention that it is important to have an alarm system but do not specify exactly what the components are or how the alarm is done and they certainly are not designed with the intent to stop play.

No headgear acceleration monitoring feature found during the patent search had an electronic system feature where the player has the option to trigger the alarm thereby stopping play. It is an important component of the current invention that the user is able to register a blow that was disorienting, to stop play and get medical assessment if the preset threshold is not reached. This aspect of the current invention is critical in assessing it as an intervention safeguard system and not a research based system. The current invention impact safety warning system is designed such that it is for use on a field of play, it does not monitor body part accelerations but headgear acceleration, it is not intended to monitor brain impacts it is designed to stop play and or allow the player to stop play if they have a significant headgear impact.

Regarding padding and the current literature; one will find there are primarily three types: die-cut foams, injection molding and traditional stuffing. It is not this inventions intent to improve upon any of these padding's but to utilize any and all in combination depending upon the sport to produce a helmet with the axial rotation control and bracing system, head and neck linking system and impact warning system tailored for that sport. The intent on manufacture would be to use traditional methods that do not infringe upon anyone's existing patent claim(s).

The current invention also is shown with a number of different types of face protection methods. The same intent is made here; that is, not to infringe upon any existing claim or special method of face protection but to use traditional methods associated with a number of sports on the current invention platform.

Some examples of improvement in padding would be published U.S. patent application US 20013/0340150 to Brantley which focused on a plurality of cushioning air bag enclosure layers filled with resilient foamed polyurethane. There is no substantial variation to the design of the headgear but a method of implementing an airbag approach to dissipate shock to the user. This patent looks at improving the safety to the wearer's head by improving the shock absorbency of the headgear by creating a new variation of padding. It does not link the neck with the head or transfer any force during impact to the torso or limit movement of the head or neck when under linear or rotational forces. This is what is seen in all headgear improvements regarding padding.

There are some patents that do look at linking the head to the torso to limit linear and rotational force transfer to the head. It is important to note that they lack the electronic safety feature option of the current invention and do not let the player do any type of notification and their method of linking the torso and head are very different from the current invention. Without exception they connect the helmet to a shoulder pad or neck collar arrangement to the torso of the player or a suit worn by the player.

For example U.S. Pat. No. 8,561,217 to Nagely, et al. is a spring three point break away strut system which provides support to the wearer's head by means of a harness assembly about the torso which is connected to the helmet by the spring loaded struts which absorb force to a predetermined velocity threshold before disconnecting the torso harness from the helmet by means of the breakaway struts.

Published U.S. patent application US 20100263110 to Berry uses magnetic couplings, one on the helmet and the other on the football shoulder pads to create an electrical field that is force resistance thereby reducing head whip-lash movement.

In U.S. Pat. No. 8,621,672 to chuback consists of a bubble type helmet comprising a dome portion configured to surround but remain spaced apart from the user's head that affixes to a shoulder pad apparatus similar to a deep sea diving suit. Definitely linking the headgear to the torso however, it lacks head and neck support of the current invention.

Regarding Headgear sensors and monitoring systems U.S. Pat. No. 8,621,673 to Pietrantonio is unique in that its sensors are portable concussion indicators for mounting to a helmet that is configured to indicate impacts relating to different concussion grades as indicated by an identifiable impact capsule. The indicator may be placed with or mounted on the exterior of a helmet. This concept is very common in the field in that the thought is to provide a method to attach to the existing headgear a component that lets you know when a head injury occurs. This is the direct opposite of the current invention idea where the electronics are imbedded within a helmet specifically manufactured for the sport. Pietrantonio's patent does not provide for a monitoring capability just notification. By building the monitoring system into the headgear it reduces the chance that the monitoring system will not be used, not attached to the headgear or left in the coach's office.

Published U.S. patent US 20120210498 to Mack describes a headgear or hard hat with sensors to sense if the headgear is being worn and having at least one optical sensor and transmitter to transmit codes for security access. Mack's patent also has a removable sensor that attaches to the headgear padding for determining the nature of head impacts that also stores the data.

Published U.S. Pat. No. 8,556,831 to Faber et al. is a portable system designed to measure linear and rotational force impacts that is a removable mechanism that can be attached to any number of things such as "helmets, headbands, and in general "headgears", and sports such as American football and Karate . . . ". It has similar qualities to the current invention in data collection in that it uses accelerometers but the intent of the use is totally different. The current invention uses accelerometer(s) to measure acceleration movement of the headgear and has an impact safety warning system to warn of a significant impact event to stop play so the player can be medically assessed. The Faber et al patent is a research device that measures the "acceleration of the user's body part" (claim 4). Therefore it is measuring the acceleration of the user's brain or head if it is worn on the head. It is important to note that it has a video camera feature, GPS, and time stamp capabilities all required components of research instruments for measuring actual force impacts on a person's "body part" designed to capture maximum data for study. The Faber et al devise is not intended as an intervention tool because unlike the current invention it lacks a user interface where the user can trigger the alarm thereby indicating a disorienting blow has been received.

Published U.S. Pat. No. 8,554,508 B2 to Crisco, III et al. is similar to the device of Faber in that it describes a portable device that can be placed within existing equipment that uses accelerometers to determine "the magnitude of linear and rotational acceleration of a direction of impact to a body part." It can also be used to measure MTBI. The language is at first little confusing in that it states " . . . any reference to a body part is understood to encompass the head and any reference to the head alone is intended to include applicability to any body part." Cisco, II et al. designed a small research based device that is light weight and can be adapted to measure almost any type of rotational or linear acceleration on a body part of any animal. Within the Summary of the Invention it says "For example, the acceleration and deceleration of birds in flight could be studied with a modified version of the present invention." Although Crisco's patent shares similarities of data capture with the current invention it is a research tool intended to be able to be used in a great number of settings or used possibly on any creature or dead body of a test animal for testing purposes.

The current invention is only intended to measure accelerations of the headgear during sporting use and is integrally manufactured within said helmet or headgear. It is not manufactured to have versatility to be put on or into other objects.

The two prior inventions are clearly research based instruments as are the others in the field, designed with great flexibility to be used to measure most anything moving which creates a clear distinction between their intended use and the current invention design and intended use.

Reebock is currently selling a sensor called Checklight™ a device designed to measure impacts that has a light indicator that goes off at a preset threshold. It is attached to a cloth skull cap. It provides a visual indicator only; green being on and functioning, yellow for if there is a head impact of caution and red for a serious head impact. There is no: data capture feature, data monitoring feature, cumulative head impact data feature and it is not associated with a headgear but can be worn without a helmet or under one. Unlike the current invention it is not helmet based and does not allow individual adjustment of the pre-determined impact threshold. It does change color when a threshold has been met but there is no alarm feature intended to stop play. If the device is under a helmet it may not be readily visible. Because it may be warn under or in conjunction with a helmet or headgear it could register a significant impact, not be visible and since it doesn't have an alarm intervention process the player would continue to play until someone notices the color change which may or may not happen. This system not having an alarm really limits its ability to stop SIS.

X2 Biosystems is currently selling a device called the XPatch which is a device for measuring head impacts. It is small, versatile and is adhered to the player in the same way a band aid is applied with an adhesive patch which holds the XPatch electronic device to the player. This system is an information collection device. It does not provide a warning to stop play nor can the device be monitored in real time or accessed wirelessly, it must physically be placed on a docking station to retrieve data.

SUMMARY OF THE INVENTION

It is the intent of the current invention to provide a sport headgear designed with an axial rotation control and bracing system designed to reduce: axis of movement, provide the ability for the player to brace for impact, and transfer additional impact force to the torso when possible. The current invention is a one piece headgear and may have many embodiments being made of polymers, padding and or resilient material that are comfortable, that can adapt to sudden impacts. The head and neck linking system is designed to link the head and neck to increase the effective mass of the head by creating a single unit and providing additional support for the neck. The impact safety warning system is designed to measure accelerations of the headgear. It is not designed as a research instrument to capture force accelerations of "body parts" such as the brain to make determinations on if a TBI has occurred or not. The current invention has a wireless communication and data storage feature that lets coaches, judges and parents be able to monitor their player(s) in real time such that if there is a significant acceleration of the head takes place the impact safety warning system will be activated and will stop play so the player can be medically assessed. The current invention does not claim to be a TBI, MTBI or SIS diagnostic tool nor is it designed with that intent or ability.

The current invention is a headgear with a multitude of embodiments intended to be used in contact sports such as boxing, American football, rugby and the like. It may or may not have a hard crown shell or encompassing shell depending on the sport for which it is specifically manufactured; conforming to the regulations of that sport with regard to individual headgear requirements. When manufactured with a hard crown shell, said crown shell would not be removable by the player during play. A headgear specifically designed with axial rotation control components that can absorb, distribute and/or dissipate the force of impact and transfer a portion of said impact force to the torso of the wearer to dissipate excessive force thereby reducing linear and rotational forces transmitted the wearer's head. A safety headgear with features like the chest extensions or chin bracing support beard, shoulder extensions, rear extension and rotational limiting bracing edge that reduce and control linear and axial rotation of the head. A safety headgear that allows limited freedom of movement of the head in all directions via a gap between axial rotation control components or a flexible linking pad interface. For various sports the gap may need to be increased or decreased to accommodate shoulder pad equipment, or the desired range of movement required, etc. A gap the wearer can control by drawing their neck down and shoulders up to brace themselves for an impact and thereby transfer part or most of the impact energy to the user's torso.

It is the intent of the current invention to create a safety headgear that can be configured to meet the requirements of multiple contact sports with a head and neck linking system to improve the effective mass of the helmet. It is the intent of the current invention to provide an impact safety warning system that measures headgear force impact data and provides instant audio and visual alarm when a pre-determined force threshold is met or exceeded. This is a critical component of the "Safety" part of this headgear because firstly it allows for the stopping of play and an on the spot assessment of the wellbeing of the player. By this process it is hoped that players who are assessed to have undergone a blow of magnitude will not be put back into play once they have possibly received a Mild Traumatic Brain Injury (MTBI) as diagnosed by appropriate medical personnel at the time of intervention and will therefore not be exposed to Second-impact syndrome (SIS). SIS is a phenomenon of a player who has MTBI or TBI being put back into play because the coach, player, judge, or parent was not notified or does not understand that a significant head impact took place. The intervention portion of notification and monitoring can also be extended to the parent/guardian, unlike current research tools being used in the field. By providing to a larger audience the ability to see impact forces and the possible affect they have the more people will be involved in the safeguarding of the player. The expansion of the data audience may include people who would be less inclined to allow continued play given pertinent data. The current invention was designed with the intent only to measure and inform via the impact safety warning system if the headgear underwent a significant acceleration event; it was not designed to measure acceleration of a "body part" or to make a TBI evaluation.

A headgear or helmet having embedded within the construction an electronic impact safety warning system having one or more single axis or multi axial accelerometers and associated electronic components designed for collecting, monitoring storing, interpreting and transmitting linear and rotational acceleration and force impact data relative the helmet in real time with the ability to also broadcast to a judging/monitoring station.

A headgear intended to be worn by a single player engaged in a sporting activity designed with the intent to collect data and measure impact events in the field on an everyday basis, during actual sport events and or practice so data can be collected to quantify helmet impact data and used to create a better understanding of equipment intervention.

A headgear that allows a pre-set threshold, to be established for an individual user, set by the user interface or a wireless device such as an I-phone with appropriate application or a laptop with wireless capabilities.

A headgear where the force measuring impact data components are not removable and not intended to be used on any other piece of equipment or body part.

A headgear where the audio and visual alarms which when triggered will instantly notify not only the user but everyone in the area when the pre-set acceleration threshold has been met or exceeded so activity can be stopped and the wearer assessed for possible neck and or closed head injury.

Also, if desired a remote judging station can be set to receive the wirelessly communicated acceleration information from an individual headgear so a player or a multitude of players can be continuously and individually monitored and evaluated from a distance in real time.

A headgear where, the user on the field of play may trigger the alarm system; thereby notifying every one of a potential injury and the need for immediate assessment.

Other advantages of the present invention will become apparent from the following detailed description in conjunction with the accompanying drawings.

BRIEF DESCRIPTION OF THE SEVERAL VIEWS OF THE DRAWING

For the purpose of illustrating the invention, there is shown in the drawings forms which are presently preferred; it being understood however, that the invention is not limited to the precise arrangements and instrumentalities shown.

FIG. 3 transverse view of the sport headgear one piece construction of the helmet crown padding and headgear axial rotation control components having a detachable crown shell.

FIG. 3*a* transverse view of the headgear crown shell.

FIG. 4 transverse view of the sport headgear similar in construction to FIG. 3 but without a hard crown shell exterior but having a resilient foam skin exterior.

DETAILED DESCRIPTION OF THE INVENTION

Figure 1:
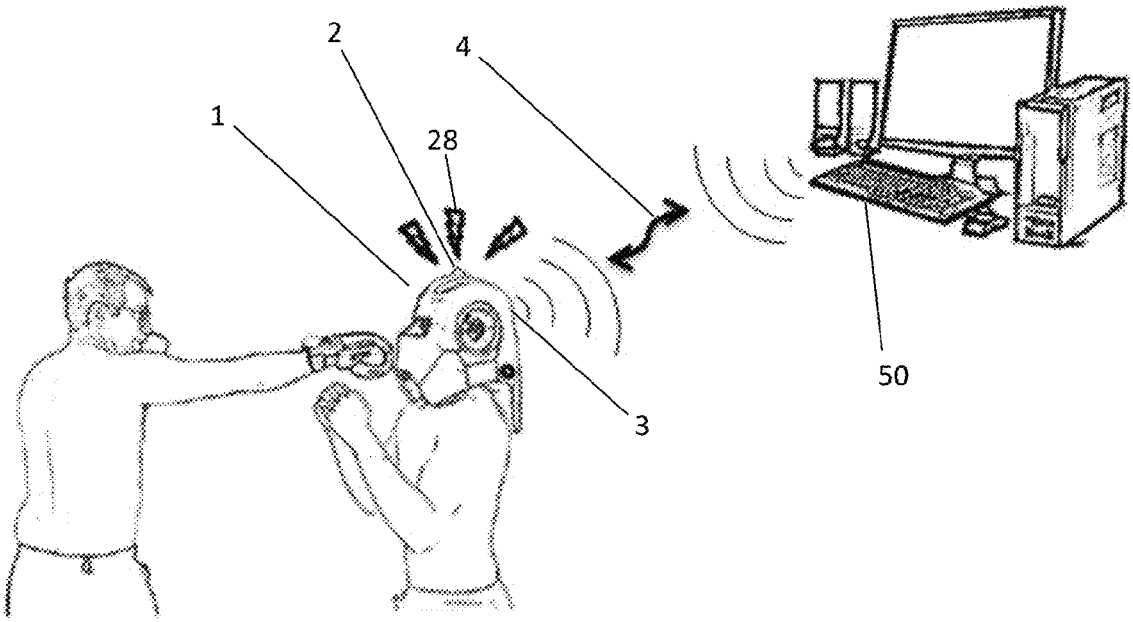
FIG. 1 transverse view of the sport headgear impact safety warning system and wireless data collection system interacting.

The description is not intended to be limiting, it is made solely for the purpose of illustrating the principles of the invention. It is not intended that the headgear representation primarily shown within the drawings limit the artistic design of the headgear. All the sport headgear depictions with the exception of FIG. 9 and FIG. 10 and FIG. 22-24 and FIGS. 28 and 29 show the current invention with a modern space headgear/helmet design. The headgear could have easily had a Viking or Samurai motif.

With regard to using the current invention the following illustrations should depict to a large extent the use and uses of the various unique items being claimed. The improvement of the current invention compared to other headgear is that the current invention has components that reduces rotational and linear range of motion, a construction that absorbs force, components that link the head and the neck in a single unit, structures that transfer force from the head to the torso and provides a set of components in a system that allows the player to brace their head for an impact from any direction.

The following narrative in conjunction with the drawings are written with the intent that any person of ordinary skill in the pertinent art would easily comprehend and be able to see the concept if improvement they embody. Additionally, the current invention is enhanced by providing a simple yet effective impact warning system designed to provide the ability to program a pre-set threshold that can be below the threshold of acceleration that may create a closed head injury. The impact warning system collects data in the hope of providing better understanding of helmet accelerations to assist in providing even more refined interventions.

This headgear's unique features allow for but do not require remote monitoring which means the headgear can be used when little to no supervision is available. Because the impact warning system is built into the headgear there is no worry of loss or damage to the impact sensors nor is there a need to visit a docking station to retrieve data. Data retrieval can be done at any time, wirelessly. The headgear can be in a player's locker and wirelessly turned on, data retrieved then turned off One significant factor of the current invention is that the impact warning system stops play without the need for an observer sitting at a remote monitoring or judging station who may or may not be watching to notice a significant impact and act to stop play. The intervention notification feature of the current invention sets it apart form research systems that people are attempting to use or claim as effective sport intervention systems. The differences are easily identified with little education. The current invention is an intervention system so it can be used when there are no observers such as when two boxers are working out in a boxing gym the protective headgear impact warning system will not only stop the play when the threshold is reached it will also provide a feature for a coach to know that the threshold was exceeded in his/her absence and have the user evaluated as an intervention to reduce SIS. Having a system that can be used in practice with little or no supervision is critical for reducing possible injuries because it is theorized that most injuries take place in practice not during the actual competitions. The current invention is designed such that the data it collects may assist in helping to answer this question.

Because the coach will have to reset the headgear when it is triggered to stop the strobe and alarm when power is on, after a threshold incident, the coach will be able to direct that the individual who received the blow not re-engage in a contest until proper time, training, safety or medical evaluation takes place even if he or she was not present for the event. This feature will assist if properly used in reducing the incidents of Secondary Impact Syndrome (SIS).

With regard to making or the manufacture of the headgear. It is the intent of the current invention to be able to be manufactured using a multitude of methods to create a headgear for a specific sport that meets that sports requirements but does not encroach on any existing patented claims. The goal is to implement the features of: a axial rotation control and bracing system, a head and neck linking system and impact safety warning system in headgear made in traditional fashion such as sewing a leather skin and stuffing it. It is also the goal of the current invention to be able to be manufactured using new methods of manufacture to improve mass production and accessibility such as injection molding, rotational casting, etc. using resilient polymers such as rubber, foam or a combination there to reduce cost per unit of the headgear so it will be more affordable and more often used.

Referring now to the drawings in detail, where like numerals refer to like parts or elements. To concisely articulate the improvement(s) being claimed and in order to succinctly connect the specific improvement with the component part(s) necessary within the component systems the component parts as illustrated are addressed in multiple figures as appropriate.

The sport headgear is depicted by the 1 is shown in each drawing and specifically numbered in FIGS. 1, 2, 3, 5-10 and 11. It is important to note that there are a variety of embodiments of this design of headgear. Each design would have at least one or a combination of or all the unique features stated in the claims of the invention.

Although individual helmets or headgear for various sports are not specifically shown or specified please note variations in the arrangement or type of headgear for a specific sport can be made without departing from the spirit or scope of the claims.

The current invention is seeking to capture four design improvements the first being the enhancement of the traditional helmet by reinventing it with a unique axial and rotational control feature. The second is the bracing ability which can be achieved by individual component use or simultaneously engaging one or more components. The third is implementation of a head and neck linking system within a single headgear thereby improving the effective mass of the head as a total unit. The fourth design improvement is the creation and implementation of the headgear impact warning system. A simple electronic system designed with two goals. Firstly, to stop play when the impact warning system is triggered so a player can be assessed for a possible head injury. Secondly, to be able to capture and utilize headgear impact data on an individual helmet/headgear in real time or when convenient so as to improve research in methods to improve headgear to reduce head accelerations.

Figure 12:
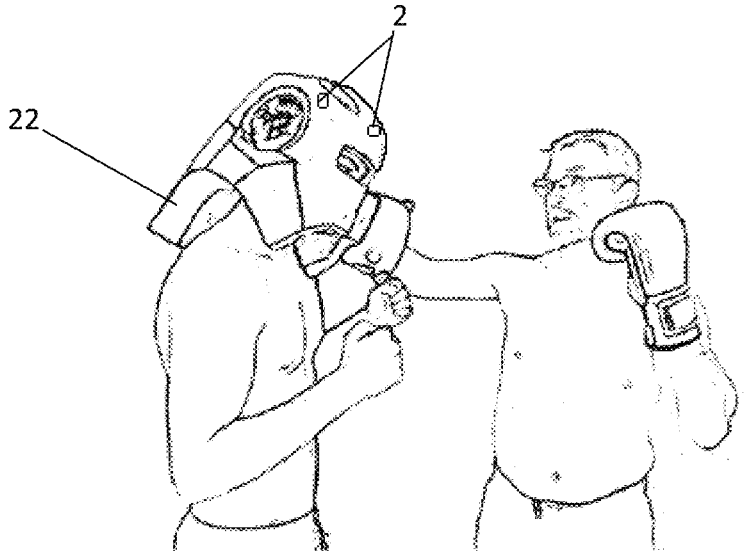
FIG. 12 transverse view of the sport headgear highlighting safety strobe points which in this rendition are a clear window in the plastic of the headgear crown shell that allows the strobe to be see when activated and the right rotational limiting bracing edge found on the rear extension.

The strobe light or light emitting diode (LED) number 2 is shown as a domed light that extends from the smooth surface of the sport headgear in FIGS. 1, 5-8, 16, 19-21. In FIGS. 2, 3, 3*a*, 4, 9, 10, 12-14, 18, 22 and 28 the strobe/LED is portrayed in a number of different locations and shown as an embedded emergency strobe within the helmet crown padding, or being behind a clear portion of the crown shell that would act as a window having an embedded strobe 18 feature as labeled in FIGS. 9, 10 22 and 28. There may also be multiple strobe/led locations so when the light portion of the emergency impact safety warning system is activated it can be seen from multiple angles as shown in FIG. 12. The idea is to have a bright light that draws attention to the helmet. The lights could be a string of lights that wrap the helmet or another variation on the theme of providing a warning light(s) that is/are visible from multiple vantage points.

Figure 27:
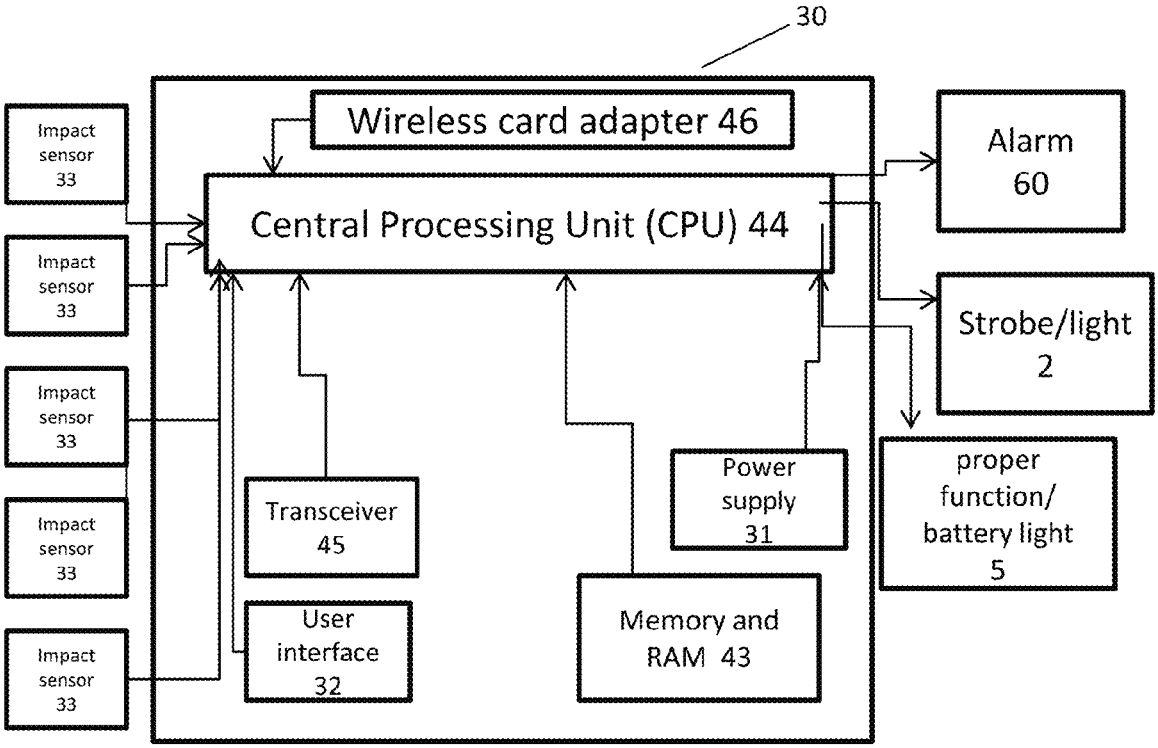
FIG. 27 is a view of the components of the wireless impact safety warning system electronic package found within the headgear.

The transceiver, number 45 shown in FIG. 27 is a component within the impact safety warning system. The transceiver provides two way connectivity between any remote wireless receiver(s) that has the appropriate access code(s) for said headgear(s) allowing access to data flow and or data storage if the appropriate access code is given. The idea is to provide wireless access for instantaneous monitoring, when desired. This would of course include the ability to have communication with a judging table or medical station or both simultaneously and could also include a parent who has the access code who is monitoring the headgear via an application on his or her cell phone.

Number 4 is a double ended arrow in FIG. 1 that portrays the two-way communication between the headgear/helmet(s) and a signal receiver(s) such as a computer or hand held device capable of receiving and sending signals. Number 50 shown in FIG. 1 is a representation of a receiving station. If the receiving station has the helmet access code it would simply monitor the force accelerations. A separate code would be required to manipulate the individual acceleration threshold for activation of the impact safety warning system, download the data, power on or off or restart the system, etc. Having preset codes for various functions will limit access to authorized individuals and make it easier for pulling data from the headgear.

Figure 22:
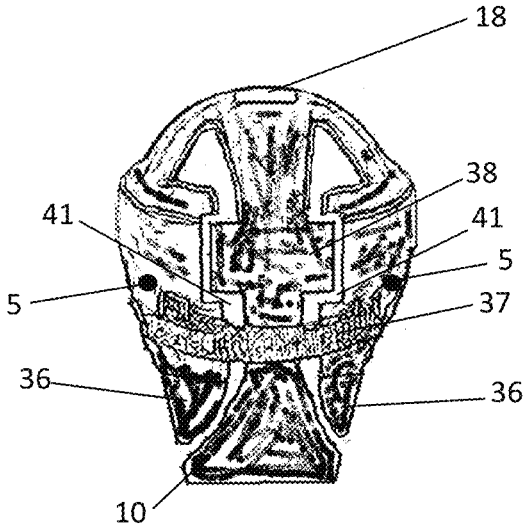
FIG. 22 rear view of an injected mold manufactured sport headgear of foam rubber with a tough skin exterior highlighting the rear closure/tightening adjustment strap and interlocking rear impact pad.
Figure 28:
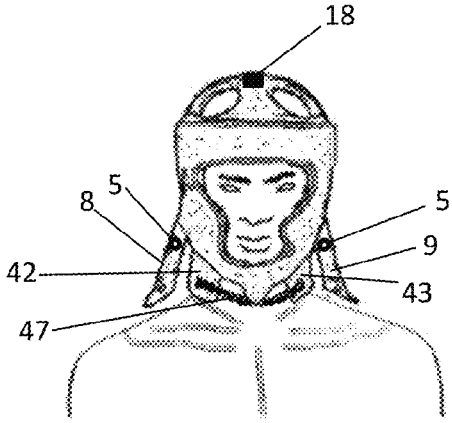
FIG. 28 is a frontal view of a safety headgear with a head and neck linking system that is separate from the axial rotation control and bracing system. Normally, the head and neck linking system will be expanded to attach to and integrally support the axial rotation control and bracing system but this embodiment does not. This embodiment has a chin bracing support beard, impact safety warning system and highlights the head and neck linking system adjustment strap.

The proper function/battery light number 5 as identified in FIGS. 2, 10, 13, 14, 16, 20-24 and 28 represent the concept that the helmet/headgear will have, when the impact safety warning system is present, at least one proper function/battery light indicator. As you can see in the aforementioned figures there are a number of locations where the proper function/battery light may be located. The concept is to be able to have the function/battery light easily seen from a number of locations. FIGS. 22 and 28 show two lights on the headgear. This allows an official(s) to easily check from a distance to see that the headgear is functioning properly as the light indicates and be able to see that the impact safety warning system is on.

Figure 6:
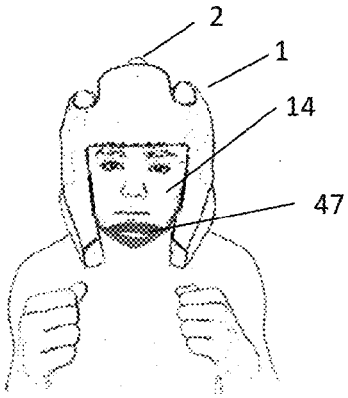
FIG. 6 frontal view of a rendition of the sport headgear constructed using foam injection molding technique having a tough foam skin with an open face design where the chin strap is visible.
Figure 23:
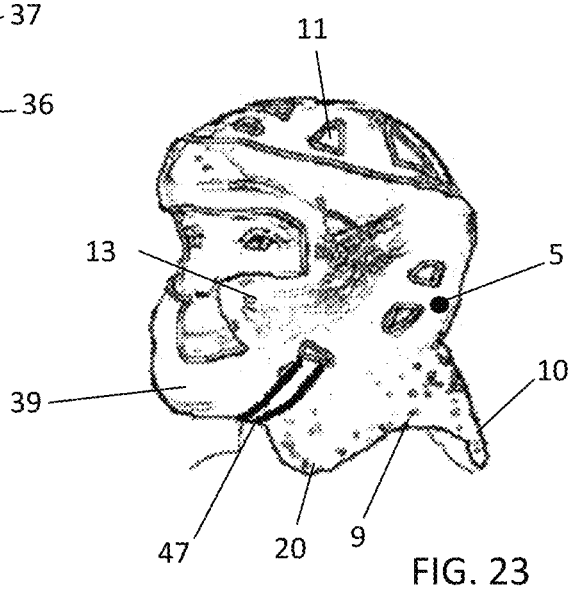
FIG. 23 is an angular view of a rotational molded sport headgear with a closed chin support made of a flexible resilient foam and reduced left chest support and angular axial rotation control left shoulder extension allowing for greater freedom of movement.
Figure 24:
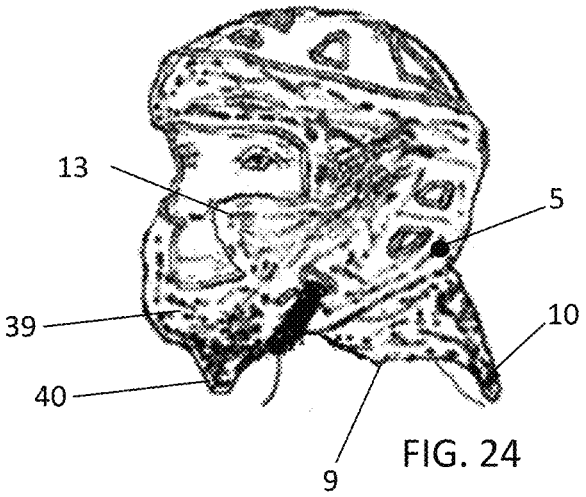
FIG. 24 is and angular view of an injected manufactured sport headgear made with a durable interior foam interior padding with an all encompassing hard shell exterior having a chin support beard which provides bracing from the front eliminating the left and right chest extension braces and allowing greater limited freedom of movement.

The chin strap 47 as shown in FIGS. 6, 23 and 24 may be made of Velcro or be a traditional buckle type closure. The chin strap may have a cup for the chin as in FIG. 6 or simply be a band under the chin as shown in FIG. 23. The goal of the chin strap is to provide as required by the embodiment of the helmet the ability to support the chin and adjust the tightness and fit of the helmet from the front.

Regarding the sport headgear, the headgear crown shell number 6 identified in FIGS. 3, 10, 11*b*, and 17-19 are made of a durable hard substance such as epoxy, plastic or fiberglass, a composite, etc. The thickness varies depending upon the sport. The tough exterior crown shell provides the first layer of protection in that it dissipates force over a larger area to enhance the force dampening characteristics of the padding under it. The crown shell is not intended to be removable by the player. The crown shell is intended to always be used when the headgear is designed to have a crown shell. The crown shell could be removed for maintenance or replacement or to gain access to the warning strobe or LED/strobe lights. Normally, the crown shell would be glued or attached with Velcro, snaps, buttons or straps to the helmet crown padding portion of the headgear in such a way that it will not come off during play. The crown shell could during manufacture be colored or painted. The crown shell may be clear or have within it clear portions that would allow the strobe light(s) 2, or embedded emergency strobe 18 and proper function/battery light(s) 5 to be easily seen when illuminated without having a bubble or protrusion on the helmet which for many sports would be undesirable.

The helmet crown padding 7 as shown in FIG. 3 is specifically designed for the fit of the crown shell 6 when it is part of the specific headgear. The helmet crown padding is designed of force absorbent material. It may have slight variations in design depending on the type of headgear and the desired requirements, for example; if it is open face or closed or if it is a boxing or hockey headgear. Regardless of its construction, (die-cut foams, injection molding and traditional stuffing methods of construction, etc.) the helmet crown padding will always be designed to support the crown shell 6 when one is used. The current invention will always have some form of air vent 11.

Figure 18:
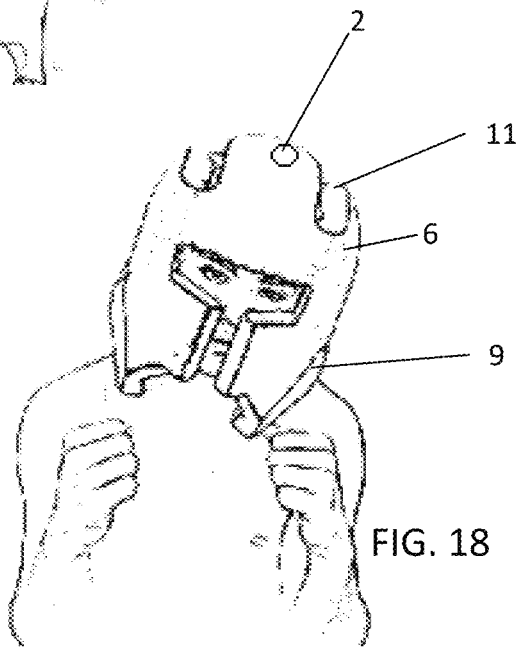
FIG. 18 front view of a sport headgear where the left shoulder clearance space is removed by the head movement along the YZ axis whereby the left shoulder extension provides support to the head and neck as a single unit.
Figure 19:
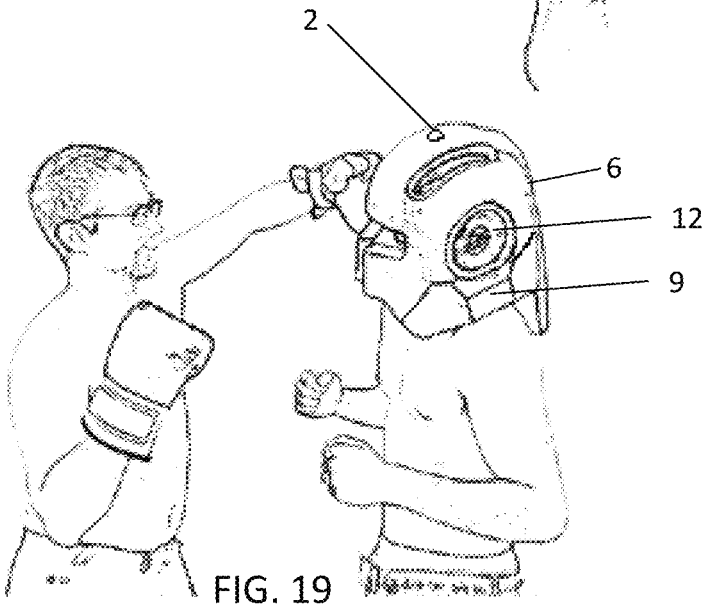
FIG. 19 transverse view of how the sport headgear limits movement during an attack along the YZ axis and transfers striking energy into the torso of the wearer.
Figure 20:
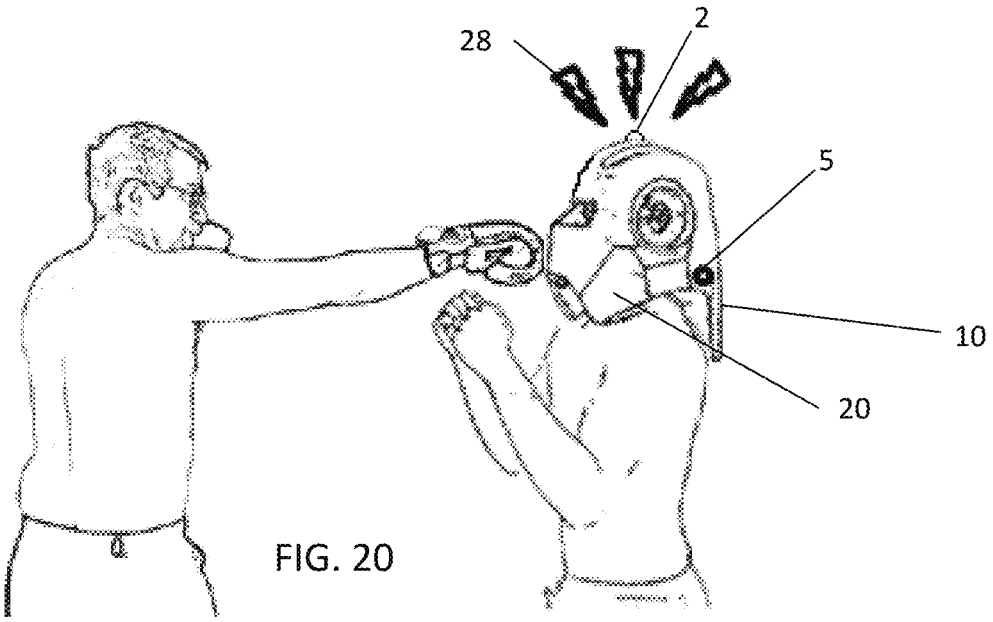
FIG. 20 transverse view of a sport headgear having a hard crown shell with exterior impact safety warning system being activated by a punch to the face. Additionally, the thrust and or whip-lash force along the XZ axis is limited by the axial rotation control rear extension.
Figure 21:
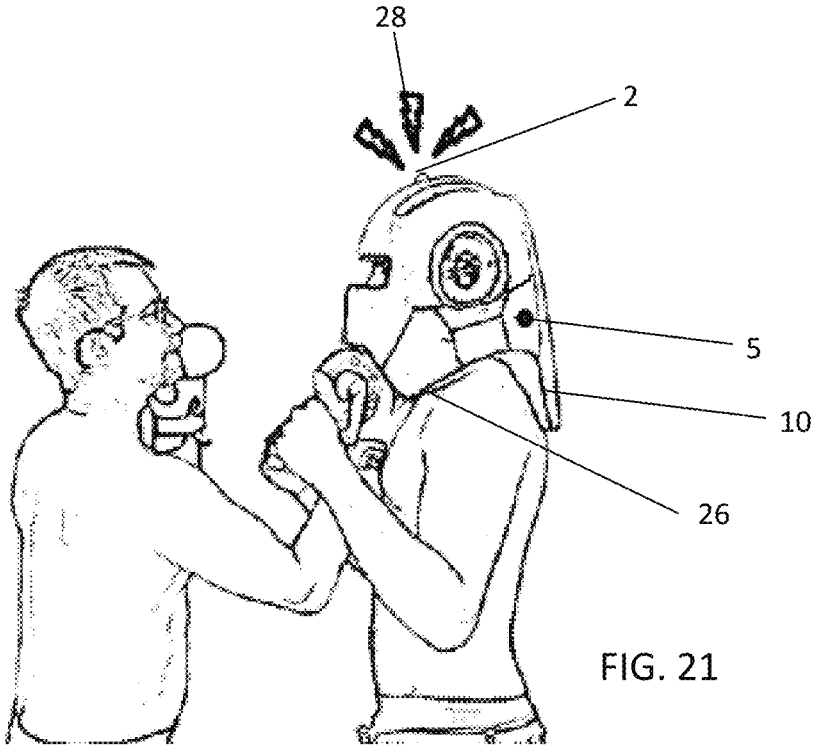
FIG. 21 transverse view of the sport headgear receiving an attack along the XZ axis showing the rotation of the head about the Z axis being limited by the axial rotation control rear extension and the increase in the chest clearance space. This attack met or exceeded the preset safety threshold so the impact safety warning system has been activated.
Figure 29:
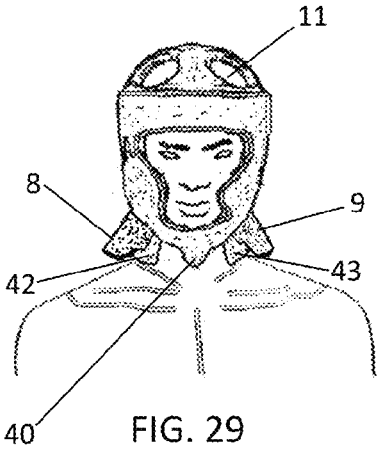
FIG. 29 is a frontal view of a headgear with the axial rotation control and bracing system and a chin bracing support beard showing an embodiment of the sport headgear where the head and neck linking system has an attached axial rotation control and bracing system without an impact safety warning system manufactured of closed cell foam with a tough foam skin exterior.

The headgear axial rotation control right shoulder extension 8 shown in FIGS. 3, 9, 10, 17, 25, 28 and 29 have the same function as the axial rotation control left shoulder extension number 9 shown in FIGS. 4, 13, 18, 19, 23-25, 28 and 29 which is to limit rotational movement of the neck about the YZ axis and to absorb and reduce impact force and transfer remaining impact force from the sport headgear to the torso of the player. In FIG. 4 it is shown that the left shoulder extension transfers force to the wearer's left shoulder when a hook to the right side of the helmet is received. In the space designed helmets the head and neck linking system is joined with the shoulder extensions. The width of the shoulder extension's 8 and 9 work similarly in design to that of a flying buttress in ancient architecture. The width of the shoulder extension's 8 and 9 can be seen in FIG. 25. This thickness could be reduced and an angular flare applied to the shoulder extensions as in FIGS. 23 and 24 making the helmet or headgear lighter and eliminating the head and neck linking system which may be desirable for various sports. The left shoulder extension 9 as shown in FIG. 18 is shown to illustrate the limiting of movement about the YZ axis. At this point the composition of the padding of the shoulder extensions absorbs what force it can by collapsing, the padding then begins transferring energy that cannot be absorbed by the padding to the torso of the player. Due to the nature of the padding it will only absorb a limited amount of force given the amount of time and movement available. Meaning, the padding will by virtue of its composition; absorb a portion of the force. A large portion of the remainder of the force will then be transferred into the torso of the person wearing the helmet as shown in FIG. 19. FIGS. 28 and 29 shows a front view of two separate embodiments of the safety headgear that makes a distinction between the head and neck linking systems left 43 and right 42 in each figure as are shown the axial rotation controlling shoulder extensions 9 left and 8 right for each figure respectively.

The Axial rotation control rear extension number 10 as shown in FIGS. 3, 8-10, 13, 17, 20-24 and 25 may be of various lengths dependent upon the sport. For example in boxing the axial rotation control rear extension will need to be longer than what it would need to be for American football because the football shoulder padding would need to be taken into consideration. Additionally, due to how the equipment affects freedom of movement the axial rotation control rear extension would need to be sculpted or curved to contact equipment appropriately. Note in FIG. 10 that there is more space between the axial rotation control rear extension in this view and the players back. This is to accommodate variations in shoulder and torso thickness. The intent of the axial rotation control rear extension is to provide a bracing point to limit the XZ axis of linear rotation of the head and neck thereby reducing the whip-lash movement of the head.

In FIG. 22 the axial rotation control rear extension 10 is supported by the rear extension helmet supports 36 which extend from the posterior edges of the headgear crown padding 7, and the dorsal edges of the shoulder extensions left and right; this particular embodiment of the headgear does not have a crown shell. Each helmet support provides rigidity, assist in alignment to the rear extension 10 and assist in determining fit and the lock of the rear extension into place. Each helmet support 36 are manufactured such that they overlap the rear extension and because of the material stiffness adds additional rigidity and shock absorbency as they support the rear extension. Additionally, they may be manufactured such that as they overlap the rear extension the rear extension may have a raised lip on it for the helmet support to arrest and terminate movement and hold the edges of each firmly in place. The helmet support(s) 36 will interlock with the rear extension to assist in determining proper fit. In this embodiment of the headgear the rear extension 10 is designed with a rear extension interlocking rear impact pad 38 which has space around it called the helmet adjustment gap 41 such that when the helmet rear closure/tightening strap 37 is tightened to enhance the fit the rear extension helmet support's 36 overlap on the outside of the rear extension 10 it the rear closure/tightening strop 37 not only provides to the rear extension 10 additional support of the rear extension helmet support's 36 it also provides additional support to the rear extension 10 which is also a component of the head and neck linking system which reduces whip-lash movement of the headgear. It is important to note that the interlocking rear impact pad 38 is designed specifically with a geometric shape that has corners that when the helmet/headgear is tightened down and the helmet adjustment gap 41 is removed by use of the helmet closure/tightening strap 37 the edges of the helmet of the rear extension helmet supports 36 shown in this embodiment of the invention locks snuggly together and will not allow the headgear to shift or slide upon its self but will flex and return or maintain its shape when struck depending on the material of manufacture. The interlocking rear impact pad 38 is also a secondary impact pad meaning if the player falls backward as in being knocked out the interlocking rear impact pad 38 is thick and designed to fit directly over the back of the head such that it covers the first area of the head to hit the ground when falling directly to the rear. The helmet adjustment gap 41 that goes around the rear extension 10 and the interlocking rear impact pad 38 also allows the headgear to be created in specific sizes because the interlocking rear impact pad 38 acts as a stop, locking the rear extension helmet supports 36 into place. This embodiment of the headgear would be popular in boxing or martial arts.

Various embodiments of the headgear lend themselves easily for variation in the front bracing system. For example the headgear shown in FIG. 23 and FIG. 24 have a built in chin support 39. A headgear with this design may have left and right chest extension bracing system as shown in FIG. 23 with the left side chest extension brace 20 clearly labeled. It is important to note that the variation between the chest extension and the chin bracing support beard for axial rotation control at the front of the helmet allows for a wide variation of uses in various sports.

As shown in the difference between FIG. 23 and FIG. 24. The chest extension braces are eliminated in FIG. 24 in favor of a chin bracing support beard 40. The chin bracing support beard 40 shown in FIGS. 24, 28 and 29 allows for greater rotational freedom of movement while still allowing the wearer to brace for head on impacts by drawing their shoulders up or by simply tucking the chin so the chin bracing support beard rests against the player's chest. The chin bracing support beard 40 has advantages over the chest extension bracing method in some sports because the chin brace support beard is smaller and on the centerline of the wearer. The chin brace support beard is also a throat protection device. It also allows the wearer to tuck their chin into their shoulders on a punch allowing for technically better technique which is important in the fighting arts which lends this helmet embodiment towards fighting sports. It is important to note that the chin brace support beard could have a split footing. Meaning the posterior edge that would contact the chest of the player when the chin is lowered may be made with a cloven hoof type concept that will allow the contact service of the chin support beard to be doubled which may be desirable in some sports. However, in other sports like American football or rugby, tucking your chin into your shoulder or getting punched in the throat is not as apt to happen so the chest extension bracing system makes more sense for these type sports. Additionally, the chin bracing support beard 40 shown in FIG. 24 affords the wearer a greater level of protection from an upper cut because it makes it more difficult to land the blow concisely on the centerline of the headgear because of the throat protection quality of this component.

The Air Vent, number 11 in FIGS. 4, 18, 23, 25 and 29 visible in almost every drawing but not labeled, is intended to convey the concept that the sport headgear has venting. The venting is a simple opening in the headgear and the shell, if intended to have a shell. The venting shown is at the top of the head in most figures. The headgear could also have venting that would be in the ear area, the back of the head, axial rotation control components, head and neck linking system and or the chin support or chin support beard which these vents may also let sweat, blood or spit exit the helmet. The variation from open faced FIG. 6 to closed face in FIG. 9 and all the possibilities between are also variations in ventilation. Ventilation gaps could also be placed such that it would be convenient for the wearer to put long hair out a vent hole should they desire to do so and if their hair is long enough. Such an example is not shown.

The Ear Pad shown as number 12 in FIGS. 4 and 19 are not integral parts of the headgear structurally. The headgear needs to have ear padding and be comfortable. It also needs to have the ability for air to move out of the headgear when struck; so the air will not compress the ear drum should the hit be directly on the ear. This is standard within any headgear, allowing air movement about the ear so compression does not happen during impact that may harm the ear drum. The current invention is no different. However, having a traditional boxing type ear pad is not part of all the embodiments although ear pads are shown in the majority of the drawings. For example FIG. 9 shows a full face head protection having a hard plastic exterior headgear that lacks ear holes, the venting is done internally FIG. 10 shows a football configuration where the hard plastic helmet portion of the headgear has a simple hole to allow air movement which is similar to the ear holes in FIGS. 23 and 24.

Figure 5:
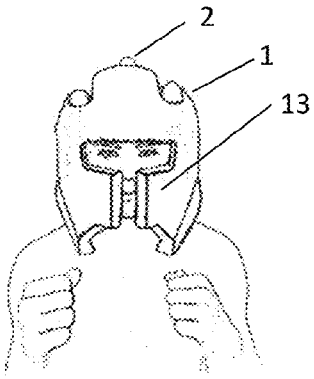
FIG. 5 frontal view of a rendition of the sport headgear constructed using rotational casting with resin exterior and foam injected core with a cheek protection face design.
Figure 7:
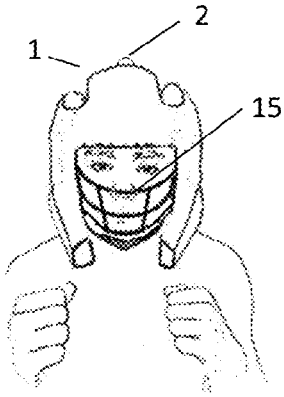
FIG. 7 frontal view of a rendition of the sport headgear constructed using a traditional padding method of stuffing a leather skin that forms the interior and exterior with a wire face protection system similar to that found in American baseball.

As shown in FIGS. 5, 23 and 24 the cheek protection headgear 13, is found within boxing and other sports as is the open face headgear 14; all soft construction as shown in FIG. 6. A wire protective cage 15 type headgears are shown in FIGS. 7 and 10 which are common in multiple sports such as American football, boxing and kendo.

Figure 8:
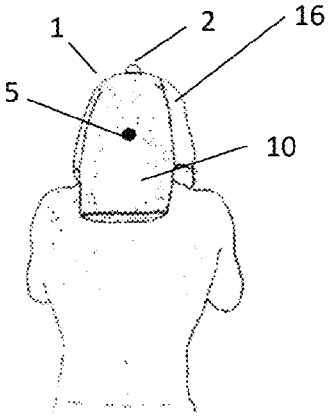
FIG. 8 rear view of a rendition of the sport headgear constructed of die-cut foams inserted into a material or synthetic covering that is sewn together highlighting the axial rotation control rear extension.
Figure 9:
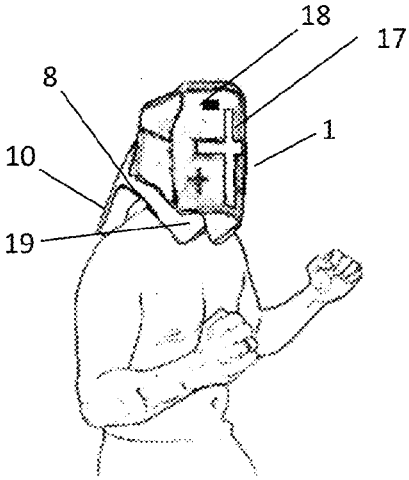
FIG. 9 transverse view of a rendition of the sport headgear constructed by injection molding of polymers having a full face and head protection hard plastic exterior crown shell that is permanently glued to the polymer constructed headgear.

One facet the current invention desires to capture within its claims is the ability to have an all soft headgear with a tough exterior skin as shown in 16 in FIG. 8; while having the flexibility to also provide a axial rotation control and bracing system and impact safety warning system that can also be used in a hard plastic crown shell design that also encloses the entire face 17, as shown in FIG. 9. This way the safety axial rotation control and bracing system and impact safety warning system benefits can be used in a variety of contact sports.

Figure 10:
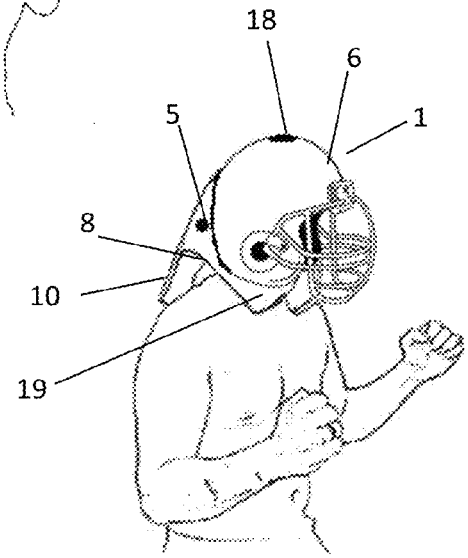
FIG. 10 transverse view of a rendition of the sport headgear constructed using an American Football helmet motif.
Figure 16:
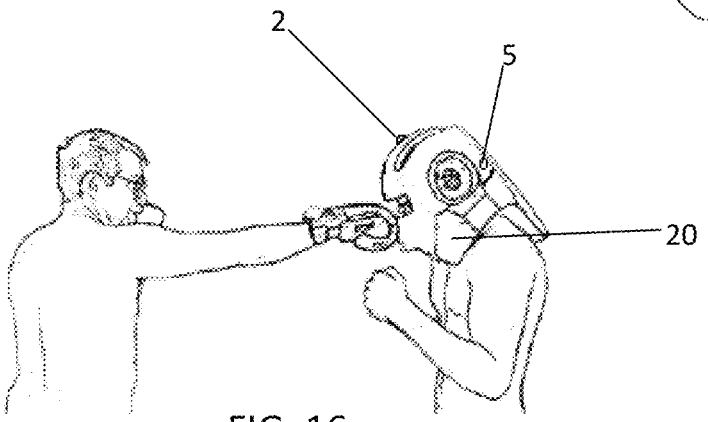
FIG. 16 transverse view of a sport headgear having a hard crown shell exterior where the wearer has braced the headgear for impact by eliminating the clearance gaps between the headgear left and right chest extensions and the torso. This allows for a reduction in head and neck rotational and linear movement and allows for force to be directly transferred to the user's torso.
Figure 17:
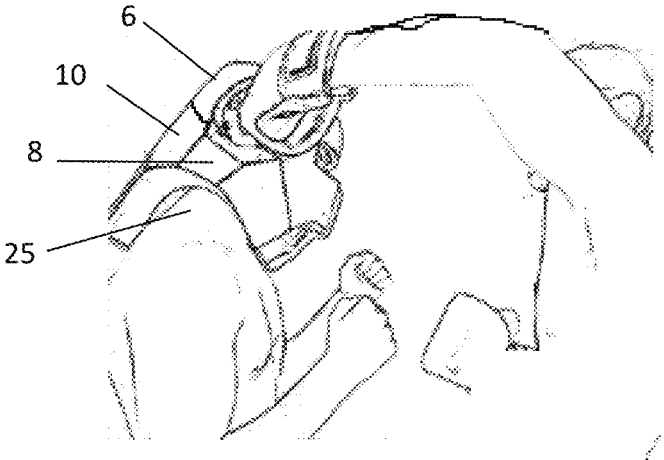
FIG. 17 transverse view of a hook to the wearer's head showing headgear movement on the YZ axis. In this view the shoulder extension clearance space right is enlarged as the force is directed threw the sport headgear via the left shoulder extension to the wearer's left shoulder.
Figure 25:
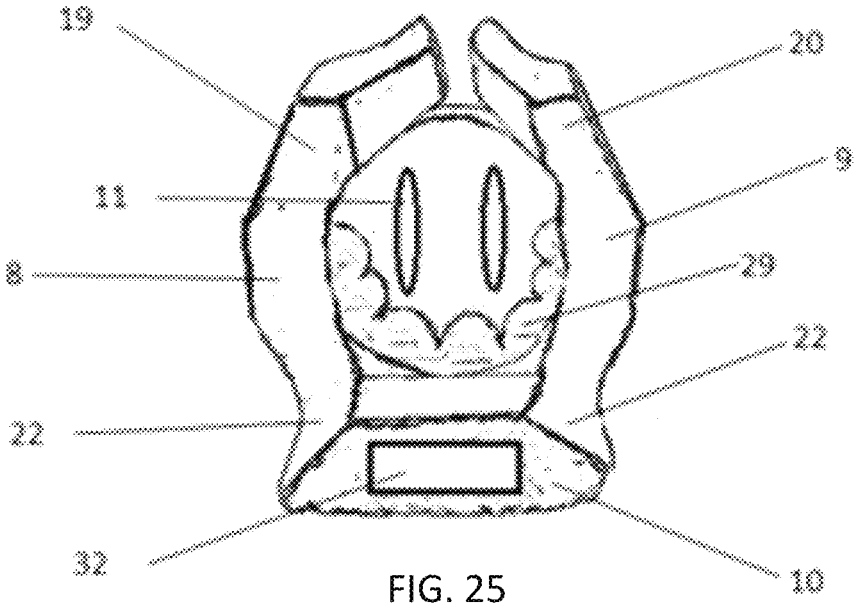
FIG. 25 is a bottom view of the sport headgear highlighting the distal edges that create contact between the axial rotation control components and the wearer to transfer force from the headgear to the torso of the wearer. Note the additional internal pneumatic or traditional padding that may be introduced to the headgear to reduce the air gap between the user's neck and the headgear thereby increasing its supportive capability.

The right side chest extension brace numbered 19 in FIGS. 9, 10 and 25 provide the same bracing functions as the left side chest extension brace numbered 20 in FIGS. 16, 20, 23 and 25 which limit the movement of the headgear on the XZ axis but more importantly allows for forward bracing of the helmet when the shoulders are drawn up, neck down and the helmet made snug against the torso for impact. FIG. 16 is an excellent example of how the sport headgear can be used to transfer energy from the head to the torso when moved to a bracing position. If you are familiar with American football you may have come across the term "Hulking" which describes how a football player draws their neck down and shoulders up to brace for an impact. The only difference is the traditional football helmet is not made to transfer energy to the torso, nor is it specifically designed for bracing as is the current invention. In the conventional American football helmet there is no force absorbent axial rotation control portions specifically designed to dissipate force, reduce linear and rotational movement, link the head and the neck or channel said force of the blow to the wearer's torso.

Figures 11, 11A, 11B:
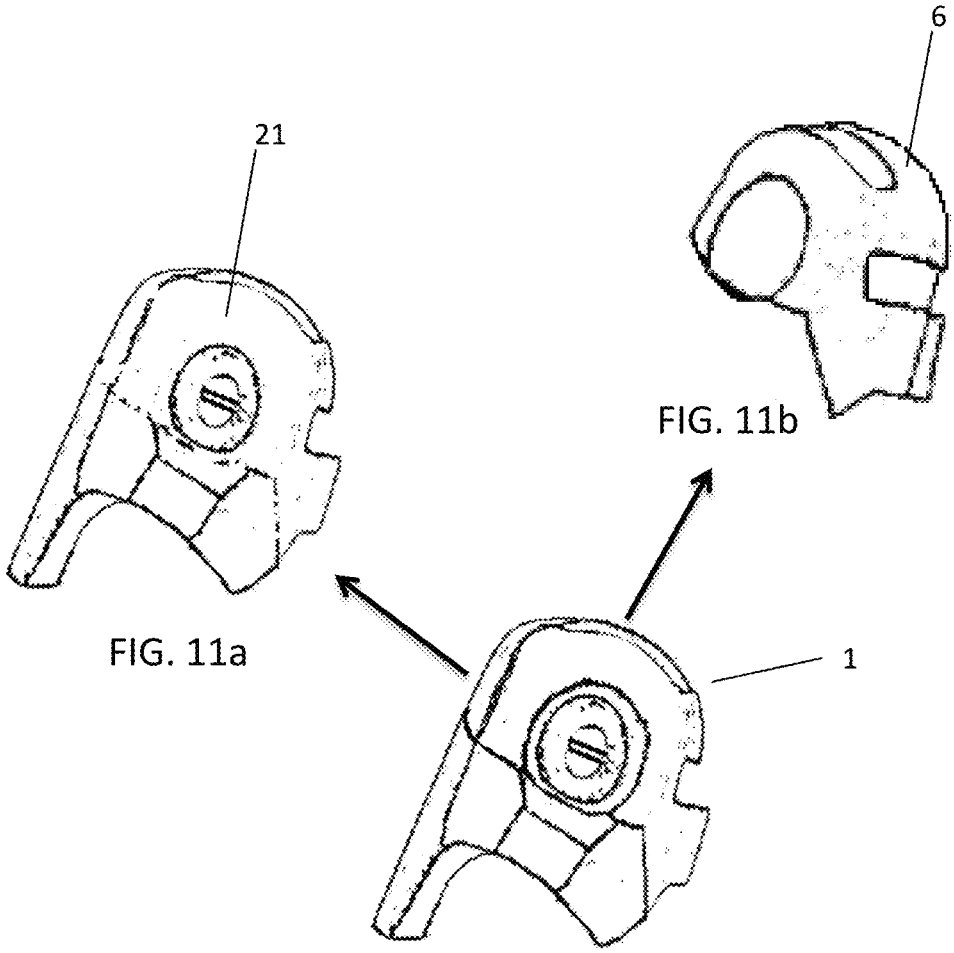
FIG. 11 side view of the sport headgear created of resilient polymers having a hard crown shell exterior.
FIG. 11*a* side view of the resilient polymer headgear without the hard crown shell exterior.
FIG. 11*b* a side view of the hard crown shell exterior.

In FIG. 11 the sport helmet 1, is shown. In this embodiment of the helmet there is a headgear crown shell 6 shown in FIG. 11*b* and the one piece crown and axial rotation control insert made of foam and or padding is shown in FIG. 11*a* identified by number 21.

Figure 13:
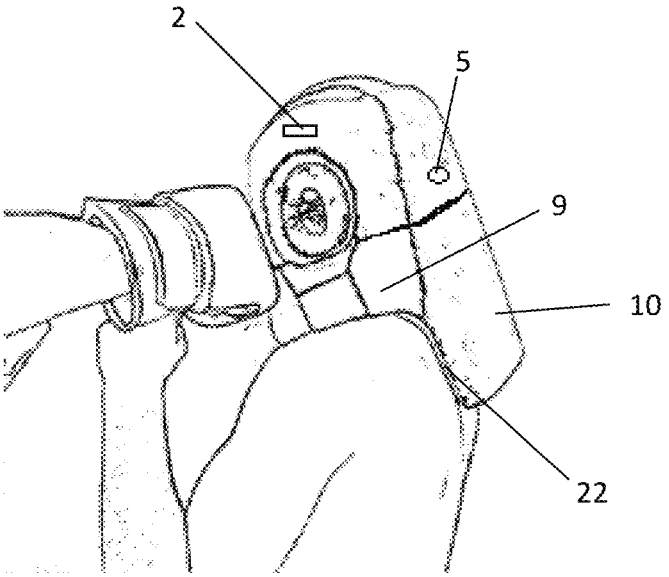
FIG. 13 transverse view of a sport headgear having a hard crown shell exterior highlighting the closing of the bracing edge gap when a rotational attack strikes the headgear; which limits the rotation of the headgear along the Z axis and allows for the transfer of energy from the headgear to the torso of the wearer.
Figure 14:
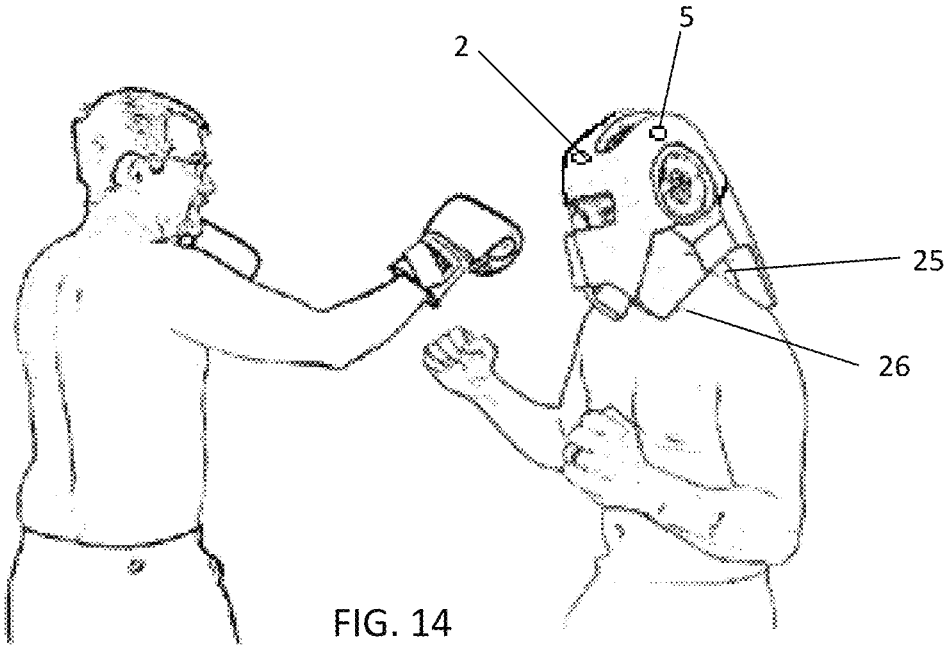
FIG. 14 transverse view of a sport headgear having a hard crown shell exterior pointing out the safety strobe, battery power indicator, axial rotation control clearance space left and chest extension clearance space left that allow for limited freedom of movement of the head.

The rotational limiting bracing edge 22 shown in FIG. 12 is the right rotational limiting bracing edge which is a component piece of the axial rotation control rear extension 10. In this particular view in FIG. 12 the headgear is being struck from the left side with a hook which provides rotational movement about the Z axis. When the neck and head rotate the axial rotation control rear extension also moves with the rotation of the helmet about the Z axis. In this case one of the rotational limiting bracing edges 22, the right will open and the other in this case, the rotational limiting bracing edge 22 on the left side as shown in FIG. 13 contacts the back and shoulder perpendicular of the wearer arresting rotation, providing bracing ability and transfers force through the helmet to the torso. FIG. 25 shows the left and right rotational limiting bracing edge 22. It is important to note that the angle of the bracing edge and the width of the edge are of great importance because of these qualities it provides the proper angle for contact and provides a large surface area for the transfer of force from the headgear to the torso.

Figure 2:
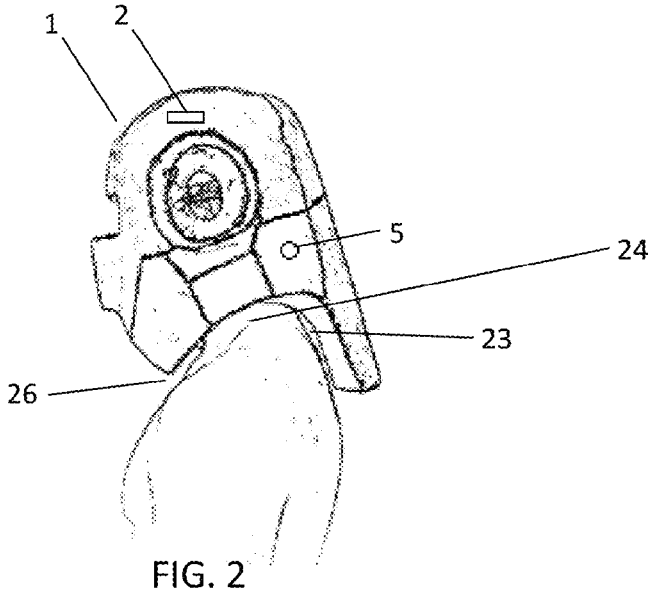
FIG. 2 side view of the sport headgear highlighting gaps between the axial rotation control assembly components and the torso of the user that allow for limited free movement in all axes.

When the sport headgear is warn there are two methods available within the current design regarding how the helmet contacts the wearer. The first is providing a headgear with a clearance gap between the headgear and the torso of the wearer. This is achieved by having an ergonomic axial rotation control design based on the size of the headgear (small, medium, large, extra large etc.) that extends but does not touch the torso of the user yet allows limited free movement in all axis. This is important because then the player will have limited range of motion but free movement of the head along the linear and rotational axis until the clearance gap(s) is/are closed on the various axial rotation control and bracing system component(s). The gap depending on the sport may need to be enhanced to accommodate shoulder pads or other component equipment. The idea is that a limited gap is created for limited but free movement in the XZ and YZ axis and rotational planes of each axial rotation control and bracing system component before contact between the player's torso and the headgear is made. Each of the following identified clearance spaces provides this function: the rear extension clearance space 23 as shown in FIG. 2, the axial rotation control clearance space left shoulder 24 also shown in FIG. 2, the axial rotation control clearance space right shoulder 25 shown in FIGS. 14 and 17, and the Chest extension clearance space left 26 shown in FIGS. 2, 14 and 21 and the Chest extension clearance space right 27 not shown in any figure, nor is the beard clearance space identified. Each allow for limited free motion before bracing and transfer of energy from the headgear to the torso takes place.

Figure 15:
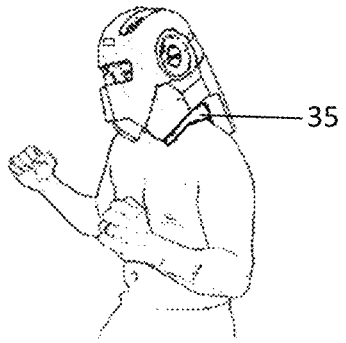
FIG. 15 transverse view of a sport headgear having a hard crown shell exterior where the headgear has a flexible linking pad interface which eliminates the gaps in the headgear axial rotation control system with the torso, yet allows for limited freedom of movement prior to bracing.

FIG. 15 shows the number 35 which points out the flexible linking pad interface 35 that directly rides against the torso of the wearer which is connected to the posterior edge(s) of the axial rotation control components. This allows the headgear to have contact with the torso while providing little to no restriction of movement within a specific range of movement. It replaces the clearance gap with a flexible linking pad that provides little to no friction or resistance to the user, yet it is not connected to the torso of the player it is a portion of the headgear.

The Axial rotation control interior padding 29 shown in FIG. 25 is important to illustrate the concept of internal padding support for the skull within the crown component of the headgear and the interior of the head and neck linking system. As with many traditional headgears adding additional padding to the interior of the headgear to improve the fit is intended. It is important the helmet have the ability to be fit to the user to reinforce the neck also, as desired. This may be achieved through adding additional padding to conform to the players needs or through a pneumatic sleeve within the axial rotation control components where the player can inflate the neck support to the desired amount.

The Impact safety warning system electronics packet 30 as seen in FIG. 27 is provided to display the intent not to limit the scope of the invention. The electronics packet 30 lists the basic component parts: the internal alarm component 60, the Strobe light 2, the proper function/battery light electronics 42, the battery 31, the memory (flash memory) and ram 43, the Central Processing Unit (CPU) 44, Transceiver 45, the Impact Sensor(s) 33, and wireless card adapter 46.

Figure 26:
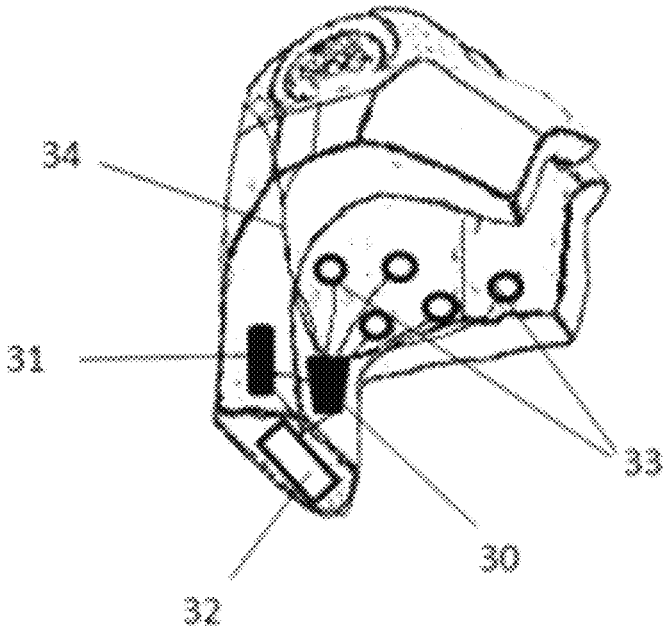
FIG. 26 is an angular view of the bottom of the sport headgear showing the internal wiring and electronic components of the impact safety warning system.

FIG. 26 shows an internal view of the major component parts of the impact safety warning system: The electronics packet 30, the Battery 31, User interface 32, Impact sensor(s) 33, wires 34 to strobe and klaxon.

FIGS. 28 and 29 show a front view of an embodiment of the safety headgear where the axial rotational control bracing system uses a chin bracing support beard 40 each have a head and neck linking system shown by the right side 42 and left side 43 head and neck linking system sides. Each have left 9 and right 8 axial rotation control shoulder extensions it is important to note in FIG. 26 there is a clear separation between the head and neck linking system and the axial rotation control and bracing system. In FIG. 29 the two systems are combined to some extent and in the space helmet designs shown predominantly thought the drawings no clear separation line is made due to the construction of the helmet.

FIG. 28 the head and neck linking system adjustment strap 47 is visible and in this embodiment necessary. The head and neck linking system adjustment strap provides the user the ability to adjust the tension and support of the head and neck linking system specifically the left side 42 and right side 43 head and neck linking system components. The back of the head and neck linking system is a portion of 10 the rear support extension, (not shown). The head and neck linking system adjustment strap 47 can also be made wider or with gaps in it for ventilation and or to allow the epiglottis of the throat freedom of movement while still providing adjustment of fit for the head and neck linking system.

There are in existence a number of headgear/helmets designed for contact sports such as American football, boxing and hockey. The prior art has some general similarities however; the current invention is unique in its construct, design, embodiments and options of embodiments in the following ways.

What is claimed is:

1. A protective sport headgear having an axial rotation control and bracing system designed to reduce linear and axial rotation of the head about the XZ and YZ axis to minimize the mechanical effect on the head; and, a sport headgear constructed of force absorbent material designed to absorb, dissipate and distribute force of impacts thereby reducing the force of direct impact transmitted to the head, having;

a one piece crown component that encompasses the skull or head which supports the axial rotation control and bracing system, and;

a bracing system designed such that the player may brace themselves from a single direction or multiple directions simultaneously for impact; meaning the player may hunch their shoulders up or move their chin/neck down or both to engage the posterior edges of the axial rotation control system against their torso with one or multiple bracing points thereby linking the torso of the player to the headgear thereby supporting the neck, allowing for direct transfer of energy of the blow from the headgear to the torso of the player, and;

a headgear constructed of a resilient force absorbent material designed to absorb a portion of impact force before transferring additional said force to the torso of the wearer, and;

a axial rotation control system that reduces the range of movement on the XZ and YZ axis reducing axial and rotational movement about the Z axis which provide the components for the bracing system bracing point(s) that work together to reduce range of motion and provide bracing ability in all axis, and;

a axial rotation control and bracing system which consist of four to six component parts, that can be engaged singly or in combination, being;

a headgear axial rotational control shoulder extension(s) having bilateral symmetry extending from the anterior edge of the crown component of the headgear's distal edge terminating prior to contacting the wearer's shoulders, providing a clearance space between the distal edge of the axial rotation control shoulder extension(s) and the wearer's shoulders that allow for bracing and reduce linear and rotational YZ axis movement when in the bracing position and;

a headgear axial rotational control rear extension, extending from the posterior edge of the crown component of the headgear distally on the posterior side of the body centered on the sagital or median plane appropriate in length to limit lateral and rotational movement about the XZ and Z axis as desired while providing a rear extension clearance space between the headgear rear extension and the wearer's back to provide freedom of movement, and;

a rear extension having a rotational limiting bracing edge, which is a surface created on the headgear rear extension such that when the headgear is rotated horizontally about the Z axis the rotational limiting bracing edge contacts the wearer's back/shoulders perpendicularly thereby limiting rotational range of movement on the Z axis and YZ axis and due to the resiliency of the axial rotation control rear extension absorbs force and transfers force to the wearers torso and;

the rear extension may have rear extension helmet support (s) left and right which extend from the posterior edges of the headgear crown padding and the dorsal edges of the shoulder extensions left and right providing rigidity, assist in alignment of the rear extension and assist in determining fit and the lock of the rear extension into place, and;

the rear extension will have an interlocking rear impact pad which is designed specifically with a geometric shape that has corners that when the helmet/headgear is tightened down and the helmet adjustment gaps removed by use of the helmet closure/tightening strap the edges of interlocking rear impact pad join the rear extension helmet supports and lock snuggly together with the rear extension and will not allow the headgear to shift or slide upon its self but will flex and return to maintain its shape when struck depending on the material of manufacture, and;

a forward bracing system which is one of two configurations, the first is;

a headgear chest extension system having bilateral symmetry extending from the anterior distal edge of the crown component of the headgear having a posterior edge in front of the chest of the wearer which extends anterior of the wearer above the chest or shoulder pads having a clearance space between the chest or shoulder pads of the wearer and the posterior edge of the chest extension(s) allowing for limited freedom of movement rotationally about XZ axis and laterally about the Z axis, but allowing for the wearer to draw their shoulders up and or tip their head forward to brace the posterior edge of the headgear chest extension system against the wearer's torso thereby bracing for an impact, and;

the second forward bracing system, is;

the chin bracing support beard which replaces the headgear chest extensions in various embodiments consisting of a chin bracing beard that extends from the posterior edge of the chin support of the helmet which provides more freedom of movement rotationally about the Z axis yet provides the wearer the ability to brace or draw their chin to their chest or to the inside of the shoulders to place the chin brace support beard against their torso or inside of their shoulder(s) and brace for a impact from the front or front side thereby transferring excess force to the torso of the wearer, and;

a chin bracing support beard that also provides the function of being a neck and throat protector inhibiting the wearer from being punched directly in the throat, and;

a chin bracing support beard that which may be split at the base multiple times to expand the bracing contact area that contacts the user's chest to provide more rigidity and comfort and;

a headgear having a chin support strap, a strap with chin cup or a strap for adjustment under the chin support portion of the headgear or chin bracing support beard or contoured portion of the headgear providing adjustment from the front of the headgear which allows adjustment so the headgear can be firmly secured, and or adjusted to the front of the user's head, and;

a headgear having a variety of face protection designs such as open face, cheek guards or closed face as found in boxing headgear or with a bar or wire type protection as found in American football, hockey, or kendo, helmets, and;

a headgear having a rear closure adjustment strap to allow the headgear to be tightened to the wearer's head, and;

a headgear having venting.

2. A protective sport headgear having an axial rotation control and bracing system of claim 1, where the headgear is constructed of padding, a pliable polymer, a foam or multi layered foam with tough foam skin exterior or a combination thereof with three embodiments the first being a soft helmet/headgear, the second a soft headgear with a hard exterior crown shell of various lengths, the third a headgear with a soft foam interior with a hard outer shell that encompasses the entire headgear, and;

the crown shell and encompassing shell are integrally part of the headgear and not removable by a player, but may be removable for maintenance.

3. A protective sport headgear having an axial rotation control and bracing system of claim 1, where the axial rotation control system components of the headgear extend from the crown portion of the headgear such that a clearance space is created to allow but limit the lateral and or rotation movement about the XZ and YZ and Z axis before the contact with the bracing points of the respective axial rotation control system components individually or simultaneously being: the headgear chest extension or chin bracing support beard, the axial rotation control shoulder extensions, the headgear rear extension and rotational limiting bracing edge off the headgear rear extension.

4. A protective sport headgear having an axial rotation control and bracing system of claim 1, where the axial rotation control shoulder extension(s) can be made of various thicknesses and lengths which extended at an angle from the crown portion of the headgear thereby extending on the Y axis, projecting out over the shoulders yet above, providing a shoulder clearance gap which allows freedom of rotational movement about the XZ axis yet limits range of movement about the YZ axis when the head is hit form either side along the YZ axis, the axial rotation control shoulder extension(s) are made to absorb and transfer impact energy to the wearer's torso.

5. A protective sport headgear having an axial rotation control and bracing system of claim 1, where the headgear axial rotation control rear extension component extending from the posterior edge of the crown component of the headgear is distally parallel to the wearer's back along the sagital (median) plane having a clearance space and adequate length which allows for limited linear XZ axis movement.

6. A protective sport headgear having an axial rotation control and bracing system of claim 1, where the sport headgear has a rotational limiting bracing edge which is a surface created on the headgear rear and or adjoining rear extension helmet supports, such that when the headgear is rotated about the Z axis the rotational limiting bracing edge contacts the wearer's back perpendicularly thereby limiting the rotational range of movement on the YZ axis and or Z axis thus stopping the rotational movement of the headgear about the YZ and or Z axis and allowing for transfer of energy from the helmet/headgear to the torso of the player.

7. A protective sport headgear having an axial rotation control and bracing system of claim 1, having a chest extension component that extends from the anterior portion of the headgear that is bilaterally symmetrical or having a chin support beard having an appropriate length extending such that when the player's head is tilted on the XZ axis the chest extension will have limited movement as the chest extension gap(s) are reduced and once contact is made bracing will take place the same would be true of for the chin bracing support beard gap and its function, and;

rotational about the Z axis of the head will also allow the edge of the outer edge of the chest extension to have limited movement about the Z axis until the outer edge of the chest extension is stopped by the inside of the wearer's shoulder thereby halting rotational movement about the Z axis allowing the wearer to be able to push their chin against the chest extension and theif inside of their shoulder to brace themselves thereby increasing rigidity of the neck, the same process can be applied to the chin bracing support beard thereby providing additional support whereby the headgear becomes a structural component creating a link between the head and upper torso supports the neck of the user to reduce and minimize mechanical rotational effect and transference of energy to the torso of the player reducing said impact transfer to the head, and;

the rotational movement and bracing processes just described for the chest extension(s) and chin bracing support beard can also work in conjunction with or simultaneously with the rotational limiting bracing edge to improve transfer of energy and bracing ability of the headgear to the torso.

8. A protective sport headgear having an axial rotation control and bracing system of claim 1, being a bracing system consisting of all or any of the following components: two axial rotation control shoulder extensions, two chest extensions or a chin bracing support beard, rotational limiting bracing edge, a rear extension as previously described all having a clearance gap between the posterior edge of said structures and the user such that when the wearer draws their shoulders up and or neck down the clearance gaps between aforementioned portions of the headgear axial rotation control components will be eliminated and the posterior edge of the headgear axial rotation control system will contact the chest, shoulders and back of the user individually or simultaneously depending upon the desire of the wearer to increase rigidity of the neck and head thereby providing additional support whereby the headgear becomes a structural component creating a link between the head and upper torso allowing the user to brace themselves for impact and thereby reduce rotational and lateral head movement and reduce normal mechanical transfer of energy effect on the head, dissipate the force of the blow through the absorption of the padding and the transfer of remaining force to the torso of the player.

9. A headgear head and neck linking system consisting of:

a neck support system that directly contacts and supports the neck, that is directly an extension of the crown component of the headgear thereby linking the head and neck within a single headgear thereby improving the effective mass by creating a single unit thereby increasing the requirement of force needed to create head acceleration thereby reducing the mechanical effect of a blow to the head, and;

material components of the headgear that extend from the distal edges of the crown component of the headgear that extend and conform to the neck of the wearer having a gap so that padding can be inserted to make direct contact with the neck of force absorbent material to support the neck and connect it directly to the crown of the headgear, and;

a head and neck linking system where the head and neck supports are on at a minimum one side, normally having three sides left, right and back of the neck for support, and;

a neck support system that is integrally manufactured within or is separate from the axial rotation control system components, and;

a head and neck linking system created of resilient force absorbing material that supports the neck and flexes with the neck and head during an impact and;

a left and right side head and neck linking system directly in contact with the neck that supports the left and or right side of the neck which are individual structures extending from the distal edge of the crown portion of the headgear and are directly manufactured and integrally part of and supported by the axial rotation control shoulder extension(s), and;

a head and neck rear linking system being a separate structure or part of the rear extension and or rear extension helmet support(s), and;

a head and neck left and right linking system being a separate structure or connected to the chest extension component, and;

a head and neck left and right linking system being a separate structure or connected to the chin support beard, and;

a head and neck lining system that has a rear helmet closure/tightening strap, and;

a head and neck linking system having a head and neck linking front adjustment strap, and;

a head and neck linking system that absorbs force as well as assists in limiting the overall range of motion available to the neck which thereby reduces the translation of the force, be it rotational or linear to the head, and;

a head and neck linking system that works in conjunction with the axial rotation control and bracing system to assist in the transfer of energy from the head and neck to the torso of the wearer when struck, and;

a head and neck linking system that flexes with the neck and head absorbing and directing force impact to the axial rotation control and bracing system.

10. A head and neck linking system of claim 9, having option for internal adjustment padding to allow for individual adjustment of fit for the interior of the headgear and head and neck linking system by the insertion of pads by means of an adhesive, lacing, Velcro, snaps, etc. that may inflate by pneumatic or viscous substance(s) to allow for individual building of the interior of the headgear to include the axial rotation control system to fit the individual and to provide resilient support from the crown of the skull the length of the neck as covered by the headgear thereby reducing the interior gap in the headgear between the users head and neck thereby enhancing the link of the neck and head and headgear thereby increasing the effective mass of the head and neck creating one unit thereby reducing head acceleration potential.

11. A head and neck linking system of claim 9, having a soft, flexible linking pad interface that connects to the distal edges of the axial rotation control system, the bracing components, that rests against the torso of the wearer that provides little to no restriction of movement within a specific range of motion, thereby offering a headgear with limited freedom of movement but no perceived or actual clearance gaps.

12. A headgear of claim 1, integrating a headgear based impact safety warning system that measures acceleration of the headgear and provides instant audio and visual alarm when a pre-determined acceleration threshold is met or exceeded, and;

having embedded within the construction of the headgear an electronic system designed for efficiently collecting, quantifying, monitoring, storing, interpreting, organizing and transmitting large quantities of linear and rotational acceleration data on headgear impacts in real time, and;

worn by a single player engaged in a sporting activity, designed with the intent to collect data and measure acceleration events in the field on an everyday basis during actual sport events and or practice, and;

designed with the intent to provide notice of a head acceleration of significance so play will be stopped so the player can be evaluated for possible head or neck injury, and;

a data storage and retrieval system so translational and rotational accelerations can be evaluated to better understand headgear acceleration to improve future equipment designs having:

An instant visual and auditory impact warning system comprising of a safety strobe/light or light emitting diode(s) (LED) that illuminate when a predetermined acceleration threshold is met or exceeded, and;

an alarm/claxon which provides an auditory warning when a predetermined acceleration threshold is met or exceeded, and;

A user interface that the user can access the functions of or to input data into the impact safety warning system, and;

having a one touch button feature that can activate the impact warning system so that the user may make notification during play or use that they have experienced a head impact that is disconcerting even if it did not meet the preset anticipated threshold, and;

an electronic system to efficiently collect, interpret and organize large quantities of real-time data, having;

one or more sensors for quantifying linear and rotational acceleration and or direction of impact forces, such as a accelerometer(s) or another such electronic impact or acceleration measuring device(s), embedded within the body of the headgear arranged to measure acceleration when contact is made with said headgear, and;

a central processing unit which gathers and processes linear, rotational and direction of impact and or acceleration data from the sensors, encodes it and has individual headgear threshold adjustment acceleration setting(s) that can be pre-set for each individual headgear based on the wearer's weight, neck size or other body mass indicator, wirelessly or via the user interface, having indicator(s) which when the headgear is struck and the threshold is exceeded triggers the headgear safety system strobe/light and alarm/claxon, allowing the wearer to be clearly and quickly identified so play can be stopped and medical assessment can take place, and;

a headgear to be used by a single user with or without a remote receiver such as a computer or phone with appropriate software application so a second or third party, etc. such as a judge, parent or medical doctor or all can monitor said data for single or multiple players and;

memory, such as flash memory which may be a chip that is non-removable and may be augmented with a removable memory device such as an SD card, or digital data storage feature that allows data to be stored if the wireless data transmitter feature is not being utilized, and;

a transceiver that allows for wireless receiving and transmitting of data to and from the headgear to a remote unit such as a laptop or other digital wireless component having software so said data can be associated to a specific headgear so data can be disaggregated, managed and reviewed in real time for safety in training or at a sports contest or stored and used longitudinally over time to assess head impact exposure and;

a battery power supply which will provide power to the sport headgear system and a function/power indicator light which lets the user and observer know that the headgear has power and is functioning properly which is visible from a distance, having a power supply which may be replaceable such as a 9 volt battery or rechargeable in nature.

13. A headgear of claim 1, having a headgear based impact warning system consist of: a safety strobe/light, an alarm/claxon, one or more sensors, accelerometer(s), a central processing unit or microprocessor, a digital data storage, flash memory or memory feature, a transceiver, a function/power light emitting diode (LED), with user interface to input data and or turn power on or off.

14. A headgear of claim 1, having a headgear based impact warning system with components that are non-removable from the headgear they are constructed within, unless specifically stated or implied such as component parts that may need to be replaced, a battery or LED which may be removed for servicing.

15. A headgear of claim 1, wherein the remote receiver for the impact warning system is a lap top computer, phone or another such device with proper software application allowing the remote receiver to act as a judging station and with appropriate code(s) allows access to the central processing unit and memory, wirelessly via the transceiver.

16. A headgear of 1, having a headgear based impact warning system which can be identified by encoding sequence number providing access to monitoring said headgear by the judging station or remote receiver providing the ability to monitor acceleration statistics for an individual and or multiple sport headgear simultaneously.

* * * * *